US010730079B2

(12) United States Patent
Richard et al.

(10) Patent No.: US 10,730,079 B2
(45) Date of Patent: Aug. 4, 2020

(54) CAM STACKING ASSEMBLY FOR A MIXED SIZED MAIL-PIECE SORTER

(71) Applicants: Craig Richard, Shelton, CT (US); Anthony Yap, Palmyra, PA (US)

(72) Inventors: Craig Richard, Shelton, CT (US); Anthony Yap, Palmyra, PA (US)

(73) Assignee: DMT Solutions Global Corporation, Danbury, CT (US)

( * ) Notice: Subject to any disclaimer, the term of this patent is extended or adjusted under 35 U.S.C. 154(b) by 0 days.

(21) Appl. No.: 16/150,560

(22) Filed: Oct. 3, 2018

(65) Prior Publication Data

US 2020/0108418 A1 Apr. 9, 2020

(51) Int. Cl.

| | |
|---|---|
| ***B07C 5/38*** | (2006.01) |
| ***B07C 1/02*** | (2006.01) |
| ***B07C 5/10*** | (2006.01) |
| ***B65H 31/06*** | (2006.01) |
| ***B65H 29/22*** | (2006.01) |
| ***B65H 29/60*** | (2006.01) |

(52) U.S. Cl.

CPC ..... *B07C 5/38* (2013.01); *B07C 1/025* (2013.01); *B07C 5/10* (2013.01); *B65H 29/22* (2013.01); *B65H 29/60* (2013.01); *B65H 31/06* (2013.01); *B65H 2403/513* (2013.01); *B65H 2701/1916* (2013.01)

(58) Field of Classification Search

CPC ..... B07C 3/06; B07C 5/362; B07C 3/065; B07C 5/38; B07C 1/025; B07C 5/10; B65H 29/22; B65H 29/60; B65H 31/06; B65H 2403/513

See application file for complete search history.

(56) References Cited

U.S. PATENT DOCUMENTS

| | | | | |
|---|---|---|---|---|
| 1,349,940 | A * | 8/1920 | Bowes | B07C 1/025 101/240 |
| 8,459,636 | B2 | 6/2013 | Moulin et al. | |
| 8,610,021 | B2 | 12/2013 | Campagnolle et al. | |
| 8,748,769 | B2 | 6/2014 | Allen et al. | |
| 9,539,617 | B2 | 1/2017 | Darmon et al. | |
| 2014/0110312 | A1* | 4/2014 | Allen | B07C 3/02 209/584 |
| 2014/0110313 | A1* | 4/2014 | Allen | B65H 31/06 209/584 |

OTHER PUBLICATIONS

"PCT Notification of Transmittal of the International Search Report and the Written Opinion", International Searching Authority, dated Oct. 8, 2019 (Oct. 8, 2019), International Application No. PCT/US2019/049480, 7 pp.

* cited by examiner

*Primary Examiner* — Thomas A Morrison

(74) *Attorney, Agent, or Firm* — Buckley, Maschoff & Talwalkar LLC

(57) ABSTRACT

According to some embodiments, a stacking assembly accepts mail-pieces traveling from a re-direct mechanism in a first direction and urges a leading edge portion of a mail-piece toward a registration wall of a sortation bin. The stacking assembly may include a plurality of neighboring cam shafts, each with at least one cam, arranged along the first direction, such that rotation of the cam shafts results in synchronized rotation of the cams to guide an incoming mail-piece. Rotation of the cam shafts may also urge a previously stacked mail-piece away from the cams, and into the sortation bin, in a second direction perpendicular to the first direction.

18 Claims, 30 Drawing Sheets

CAM STACKING ASSEMBLY FOR A MIXED SIZED MAIL-PIECE SORTER

TECHNICAL FIELD

Some embodiments are directed to a cam stacking assembly for a mixed sized mail-piece sorter. In particular, embodiments disclose a cam stacking assembly having a plurality of neighboring cam shafts, each with at least one cam.

BACKGROUND

Automated equipment is typically employed in industry to process, print, and/or sort sheet material for use in manufacture, fabrication and mail-stream operations. One such device associated with some embodiments described herein is directed is a mail-piece sorter which sorts mail into various sortation bins or trays for delivery.

Mail-piece sorters are often employed by service providers, including delivery agents, e.g., the United States Postal Service ("USPS"), entities which specialize in mail-piece fabrication, and/or companies providing sortation services in accordance with the Mail-piece Manifest System ("MMS"). Regarding the latter, most postal authorities offer large discounts to mailers willing to organize/group mail into batches or trays having a common destination. Typically, discounts are available for batches/trays containing a minimum of two hundred (200) or so mail-pieces.

The sorting equipment organizes large quantities of mail destined for delivery to a multiplicity of destinations, e.g., countries, regions, states, towns, and/or postal codes, into smaller, more manageable, trays or bins of mail for delivery to a common destination. For example, one sorting process may organize mail into bins corresponding to various regions of the U.S., e.g., northeast, southeast, mid-west, southwest and northwest regions, i.e., outbound mail. Subsequently, mail destined for each region may be sorted into bins corresponding to the various states of a particular region e.g., bins corresponding to New York, New Jersey, Pennsylvania, Connecticut, Massachusetts, Rhode Island, Vermont, New Hampshire and Maine, sometimes referred to as inbound mail. Yet another sort may organize the mail destined for a particular state into the various postal codes within the respective state, i.e., a sort to route or delivery sequence.

Note that a service provider might want to process a batch of mail-pieces of varying sizes. For example, a batch might include postcards, standard business envelopes, "full page" envelopes, etc. Typically, a singular tack kick on a tailing edge of a mail-piece might be used to prevent lead edge to trail edge collisions when stacking. This, however, might only be effective when processing mail-pieces of similar size. Moreover, sortation equipment has been made smaller to accommodate the physical limitations of available space, and throughput requirements continuously increase. As the throughput requirements increase, the speed of operation increases commensurately which can increase the frequency of jams or damage to mail-pieces as they are diverted from a high-speed feed path to one of the sortation bins. Damage can occur when a mail-piece comes to an abrupt stop, remains in contact with a high-speed belt or continuously operating roller, collides with a neighboring mail-piece, etc.

Various attempts have been made to control the divert/stacking function and configure the sortation bin such that a jams and damage are mitigated when a mail-piece is collected/accumulated in a sortation bin. In Stephens et al. U.S. Pat. No. 4,903,956, a divert/stacking assembly includes rotating arm which is driven about an axis which is substantially orthogonal to the feed path and in-plane with sheet material at it travels, on-edge, along the feed path. Once the leading edge of the sheet material comes to rest against a registration stop, the arm is activated to urge the trailing edge of the sheet material into the bin, thereby causing the edges of the accumulated sheets to be in register and each of the sheets to be parallel. While systems such as that described in the "956, patent improve the general alignment of sheets within a sortation bin, such divert/stacking assemblies do not account for variable forces which may be required to divert such sheet material or sheet material which may vary in weight or thickness or size. Furthermore, as the rotating arms or urge rollers continue to operate, such divert/stacking assemblies can damage the sheet material.

A need, therefore, exists for a stacking assembly which aligns sheet material, e.g., mail-pieces of various sizes, in a sortation bin while mitigating jams and damage to the sheet material.

SUMMARY

According to some embodiments, a stacking assembly accepts mail-pieces traveling from a re-direct mechanism in a first direction and urges a leading edge portion of a mail-piece toward a registration wall of a sortation bin. The stacking assembly may include a plurality of neighboring cam shafts, each with at least one cam, arranged along the first direction, such that rotation of the cam shafts results in synchronized rotation of the cams to guide an incoming mail-piece. Rotation of the cam shafts may also urge a previously stacked mail-piece away from the cams, and into the sortation bin, in a second direction perpendicular to the first direction.

Some technical advantages of some embodiments disclosed herein are improved systems and methods to aligns sheet material, e.g., mail-pieces of various sizes, in a sortation bin while mitigating jams and damage to the sheet material.

DETAILED DESCRIPTION

In the following detailed description, numerous specific details are set forth in order to provide a thorough understanding of embodiments. However, it will be understood by those of ordinary skill in the art that the embodiments may be practiced without these specific details. In other instances, well-known methods, procedures, components and circuits have not been described in detail so as not to obscure the embodiments.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present invention relates to a new and useful divert/stacking assembly for a sortation device. The divert/stacking assembly is described in the context of a sortation device, however, the invention is equally applicable to any sheet material sorter, e.g., linear, back-to-back, or tiered. The sheet material being sorted is commonly a finished mail-piece, however other sheet material is contemplated, such as the content material used in the fabrication of mail-pieces, i.e., in a mail-piece inserter. In the context used herein, "mail-piece" means any sheet material, sheet stock (postcard), envelope, magazine, folder, parcel, or package, which is substantially "flat" in two dimensions.

Figure 1:
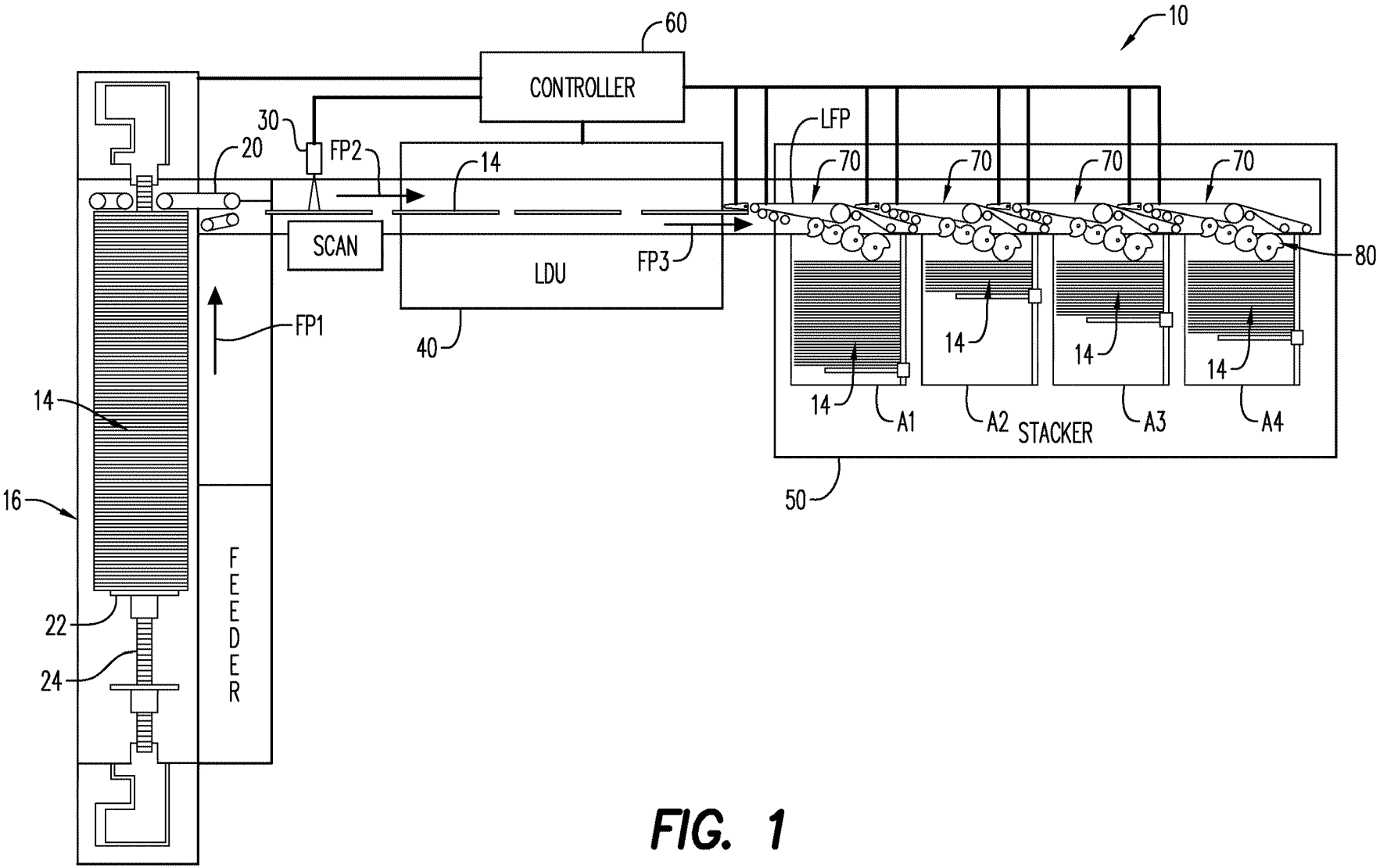
FIG. 1 is a top view of a mail-piece sorter including a stacker for receiving and sorting mail-pieces of various sizes into a plurality of sortation bins.

In FIG. 1, a plurality of mail-pieces are fed, scanned and sorted by a multi-tiered sorting system 10. Before discussing the various processing functions, it will be useful to become familiar with the physical arrangement of the various modules. The principle modules of the multi-tiered sorting system 10 include: a sheet feeding apparatus 16, a scanner 30, an optional Level Distribution Unit ("LDU") 40, a stacker/sorter 50, and a controller 60. With respect to the latter, the overall operation of the multi-tiered stacker/sorter 10 is coordinated, monitored and controlled by the system controller 60. While the sorting system 10 is described and illustrated as being controlled by a single system processor/controller 60, it should be appreciated that each of the modules 16, 30, 40 and 50 may be individually controlled by one or more processors. Hence, the system controller 60 may also be viewed being controlled by one or more individual microprocessors.

The sheet feeding apparatus 16 accepts a stack of mail-pieces 14 between a plurality of singulating belts 20 at one end and a support blade 22 at the other end. The support blade 22 holds the mail-pieces 14 in an on-edge, parallel relationship while a central conveyance belt 24 moves the support blade 22, and consequently, the stack of mail-pieces 14, toward the singulation belts 24 in the direction of arrow FP ("Feed Path").

Once singulated, the mail-pieces 14 are conveyed on-edge, in a direction orthogonal to the original feed path FP of the mail-piece stack. That is, each mail-piece 14 is fed in an on-edge lengthwise orientation across or passed a scanner 30 which identifies and reads specific information on the mail-piece 14 for sorting each mail-piece 14 into a sortation bin A1-A4 (discussed hereinafter when describing the sorter 50). Generally, the scanner 30 reads the postal or ZIP code information to begin a RADIX sorting algorithm. The scanner 30 may also be used to identify the type of mail-piece/parcel, e.g., as a postcard, magazine, which may be indicative of the weight or size of the mail-piece 14 being sorted.

Following the scanning operation, each mail-piece 14 is optionally conveyed to the Level Distribution Unit ("LDU") wherein, each mail-piece 14 may be routed via a series of diverting flaps/vanes, to an appropriate level or tier A, B, C or D of the multi-tiered sorter. The level A, B, C or D is determined by the controller 60, based upon the information obtained by the scanner 30. For example, if a mail-piece is destined for bin C3, the LDU 40 routes a mail-piece 14 to level C by diverting the input feed path to a lower feed path. It should be appreciated that the LDU may handle and route mail-pieces 14 in a variety of ways to distribute mail-pieces from an input feed path FP to an output feed path, including the use of conventional nip rollers, spiral elastomeric rollers, opposing belts, etc. Furthermore, the orientation may be inverted from an on-edge to a horizontal orientation by a conventional twisted pair of opposing belts and/or visa-versa to reverse the orientation, i.e., from a horizontal to an on-edge orientation (not shown) by the same type of inverting mechanism. While the Linear Feed Path ("LFP"), may be defined by dedicated belt drive mechanisms, the present invention employs elements of an inventive divert/stacking assembly 70 to convey the mail-pieces along the linear feed path LFP and into sortation bins via a cam stacking assembly 80 in accordance with any of the embodiments described herein.

Figure 2A:
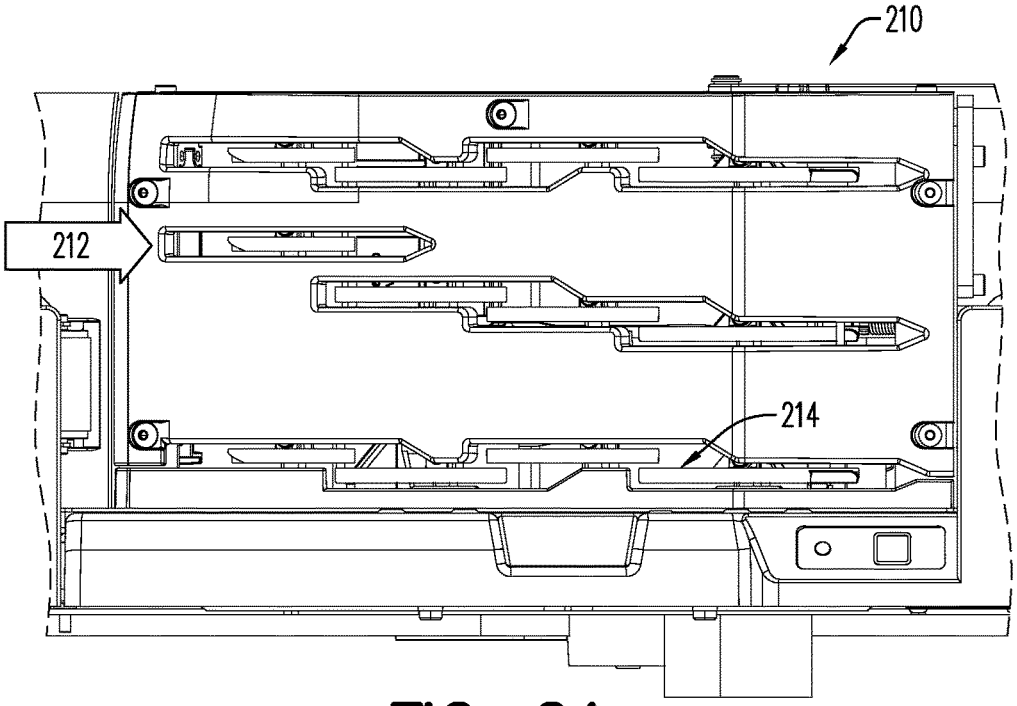
FIG. 2A is a side view of a cam stacking assembly according to some embodiments.
Figure 2B:
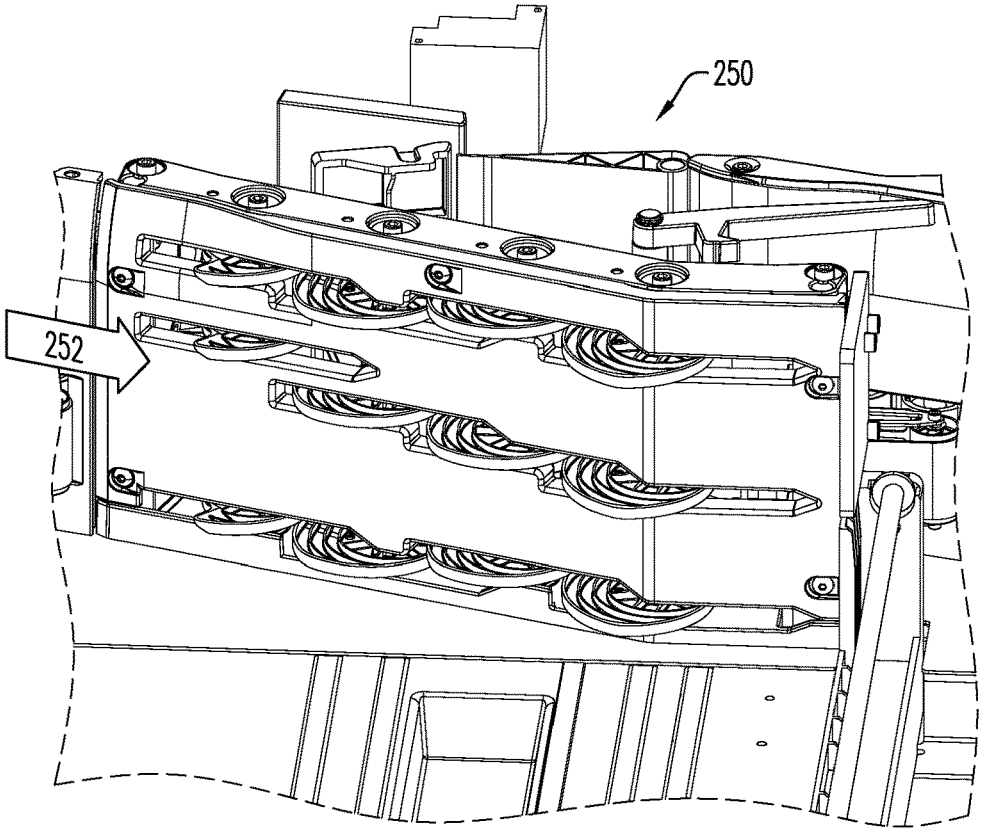
FIG. 2B is a perspective view of a cam stacking assembly in accordance with some embodiments.

For example, FIG. 2A is a side view of a cam stacking assembly 210 according to some embodiments. The cam stacking assembly 210 has four (4) sets of cam shafts (arranged horizontally in FIG. 2A) with each containing three (3) cams 214 (arranged vertically in FIG. 2A). Each cam shaft has different shaped cams 214 which help guide an incoming mail-piece from direction 212 (e.g., from a re-direct mechanism) while also pushing previously stacked mail out of the way. FIG. 2B is a perspective view of a cam stacking assembly 250 processing mail-pieces arriving from direction 252 in accordance with some embodiments.

Figure 3:
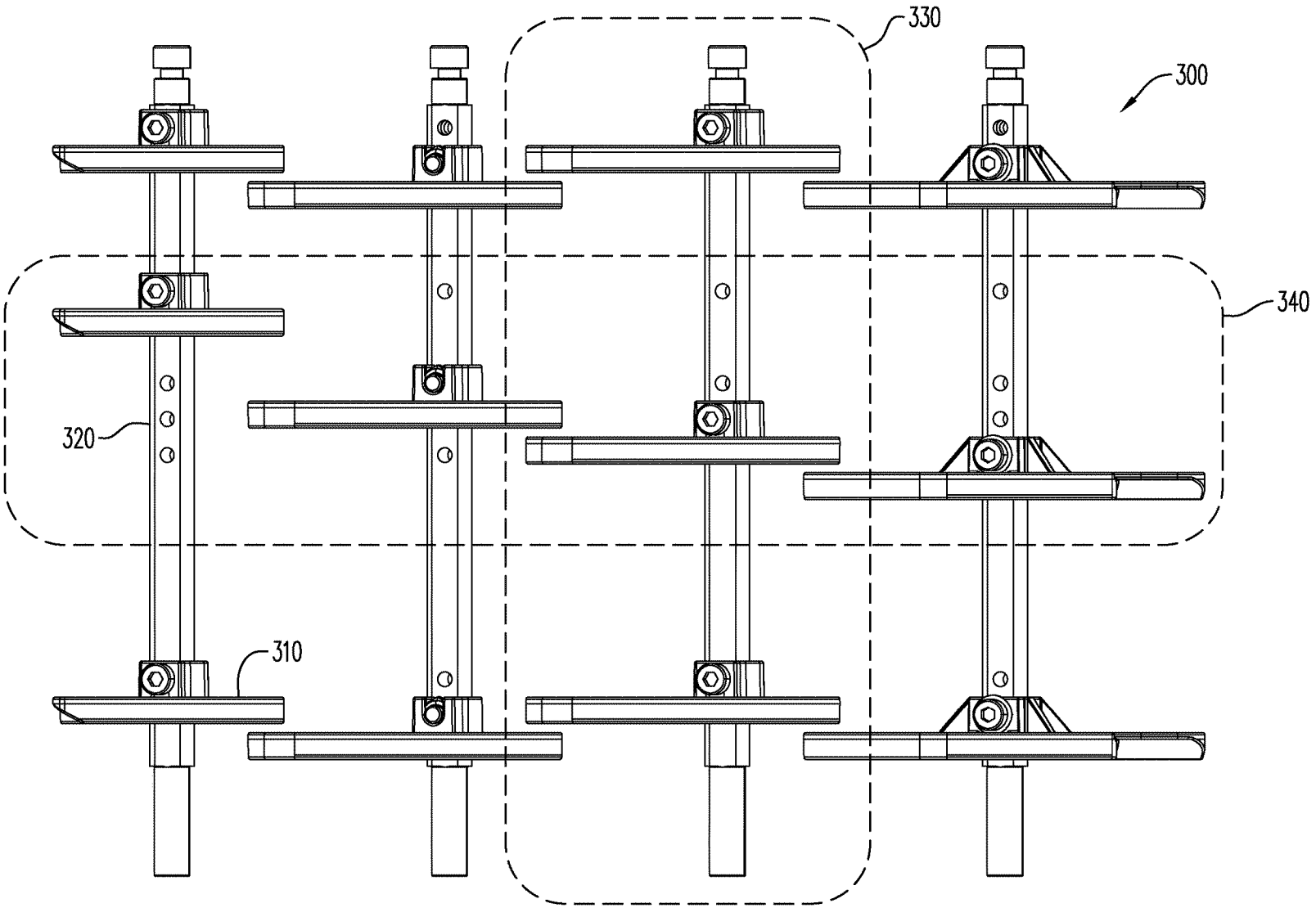
FIG. 3 is a side view of a cam arrangement for a stacker according to some embodiments.
Figure 4:
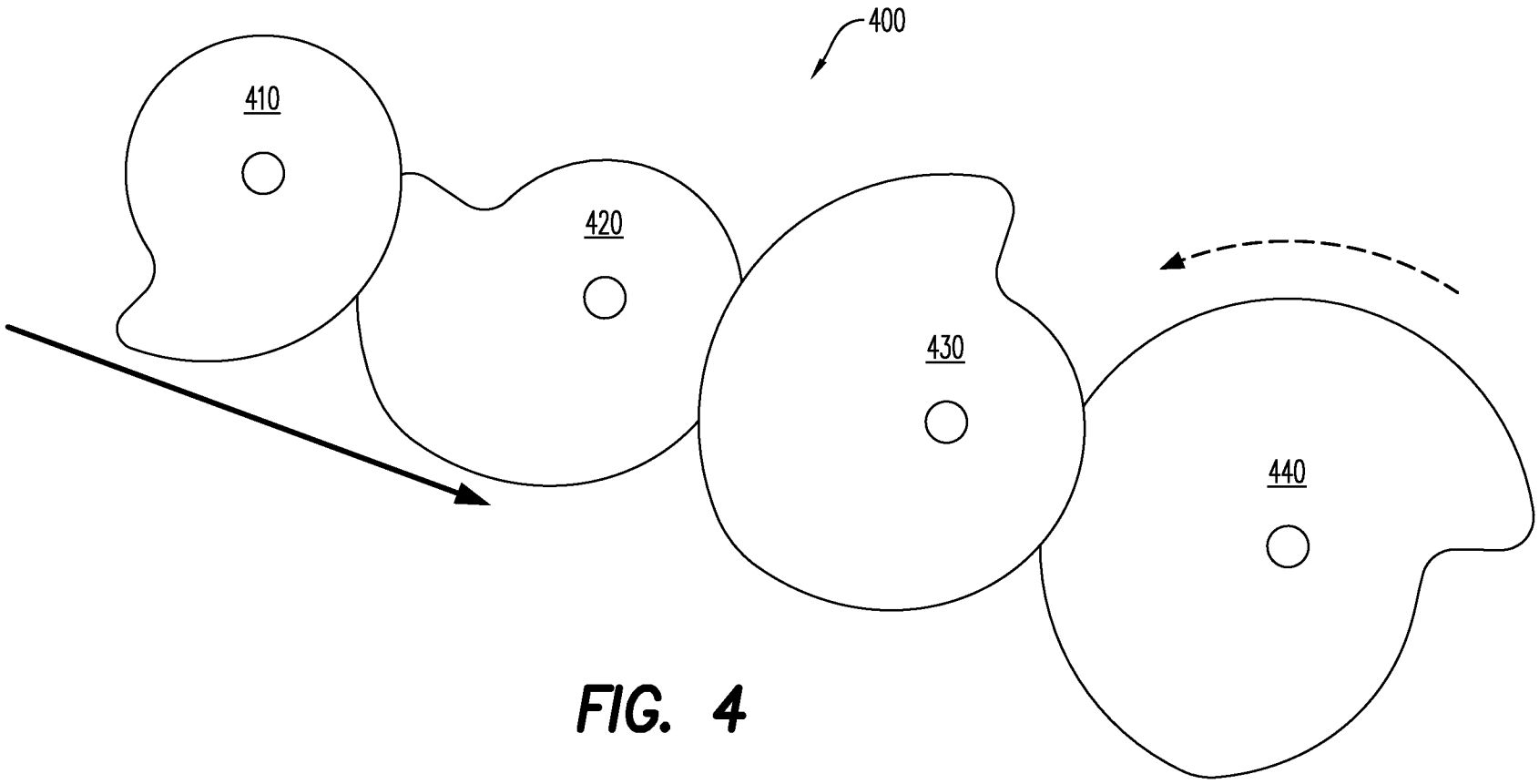
FIG. 4 is a top view of a cam arrangement for a stacker in accordance with some embodiments.

FIG. 3 is a side view of a cam arrangement for a cam stacker assembly 300 according to some embodiments. The arrangement includes a plurality of neighboring cam shafts 320, each with at least one cam 310, arranged along the first direction (e.g., from left to right in FIG. 3), such that rotation of the cam shafts results in synchronized rotation of the cams to: (i) guide an incoming mail-piece, and (ii) urge a previously stacked mail-piece away from the cams 310, and into a sortation bin, in a second direction perpendicular to the first direction (e.g., out of the page of FIG. 3). According to some embodiments, at least one cam shaft 320 has a plurality of cams 310 arranged along the shaft forming a "column" 330 of cams 310. According to some embodiments, each cam 310 in a cam shaft 320 is proximate to at least one associated cam 310 in a neighboring cam shaft 302 to form a "row" 340 of cams. As illustrated in FIG. 3, the assembly 300 includes a total of four cam shafts and a total of three cam rows. Moreover, each cam 310 in a cam shaft 320 is offset along the cam shaft 320 with respect to cams 310 in neighboring cam shafts 310, within the same cam row 340, allowing them to overlap in the first direction. For example, FIG. 4 is a top view of a cam arrangement for a stacker 400 including four cams 410, 420, 430, 440 that process mail-pieces that arrive in a first direction (the solid arrow of FIG. 4) in accordance with some embodiments.

Figure 5:
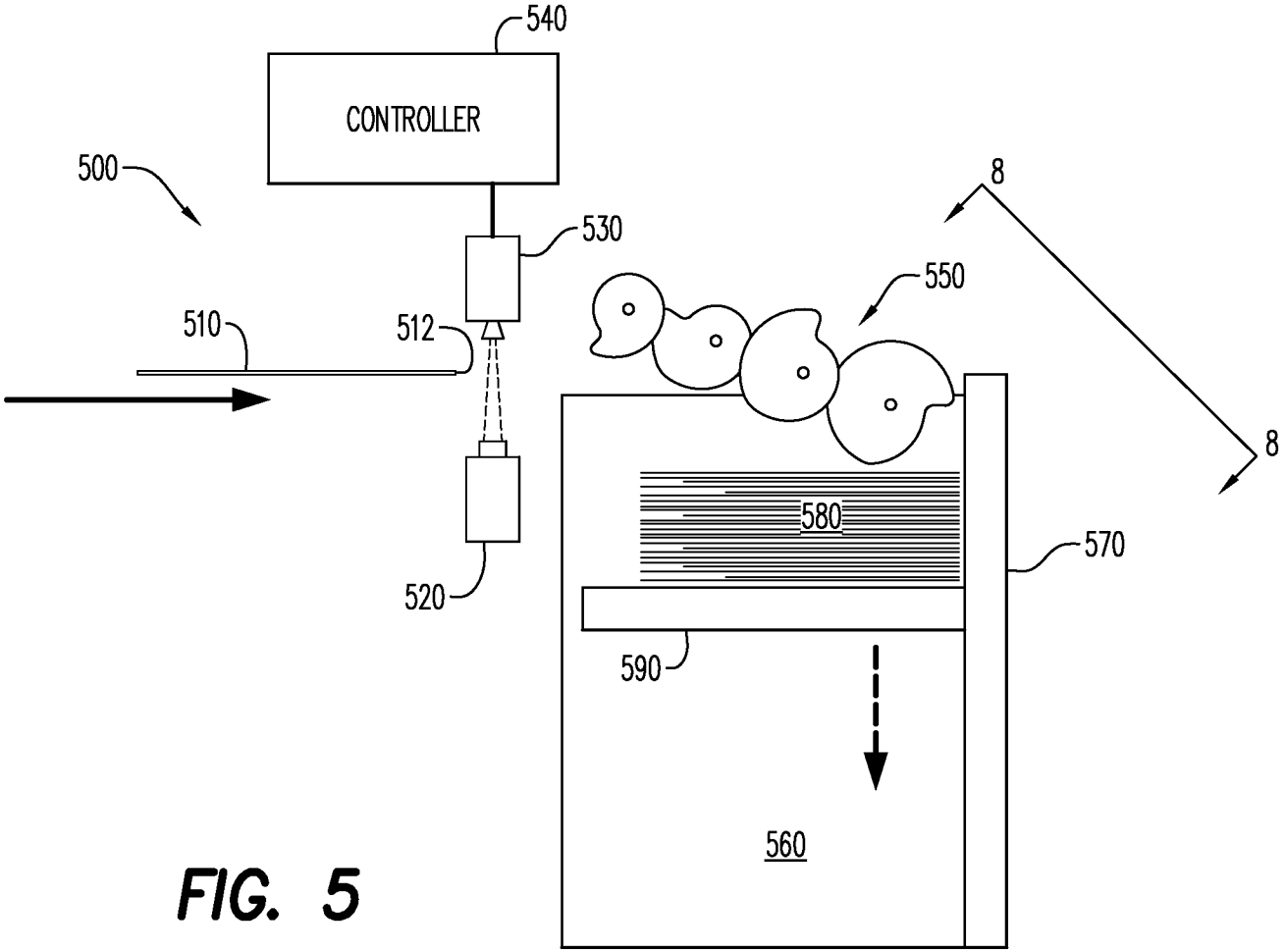
FIG. 5 is a high-level top view of a cam stacking assembly according to some embodiments.

FIG. 5 is a high-level top view of a cam stacking assembly 500 according to some embodiments. An incoming mail-piece 510 arrives in a first direction (as illustrated with the solid arrow of FIG. 5). A beam source 530 transmits a beam that is detected by a beam sensor 530. When a leading edge 512 of the mail-piece "breaks" or "blocks" the beam, the sensor 530 sends a trigger signal to a controller 540 causing it to initiate rotation of a set of cam shafts 550 in accordance with any of the embodiments described herein. The incoming mail-piece 510 travels toward a registration wall 570 of a sortation bin 560. As mail 580 is stored into the sortation bin 560, the cam shafts 550 will gently push the mail causing a paddle wall or assembly 590 to move in a second direction perpendicular to the first direction (as illustrated with the dashed arrow in FIG. 5).

Figure 6:
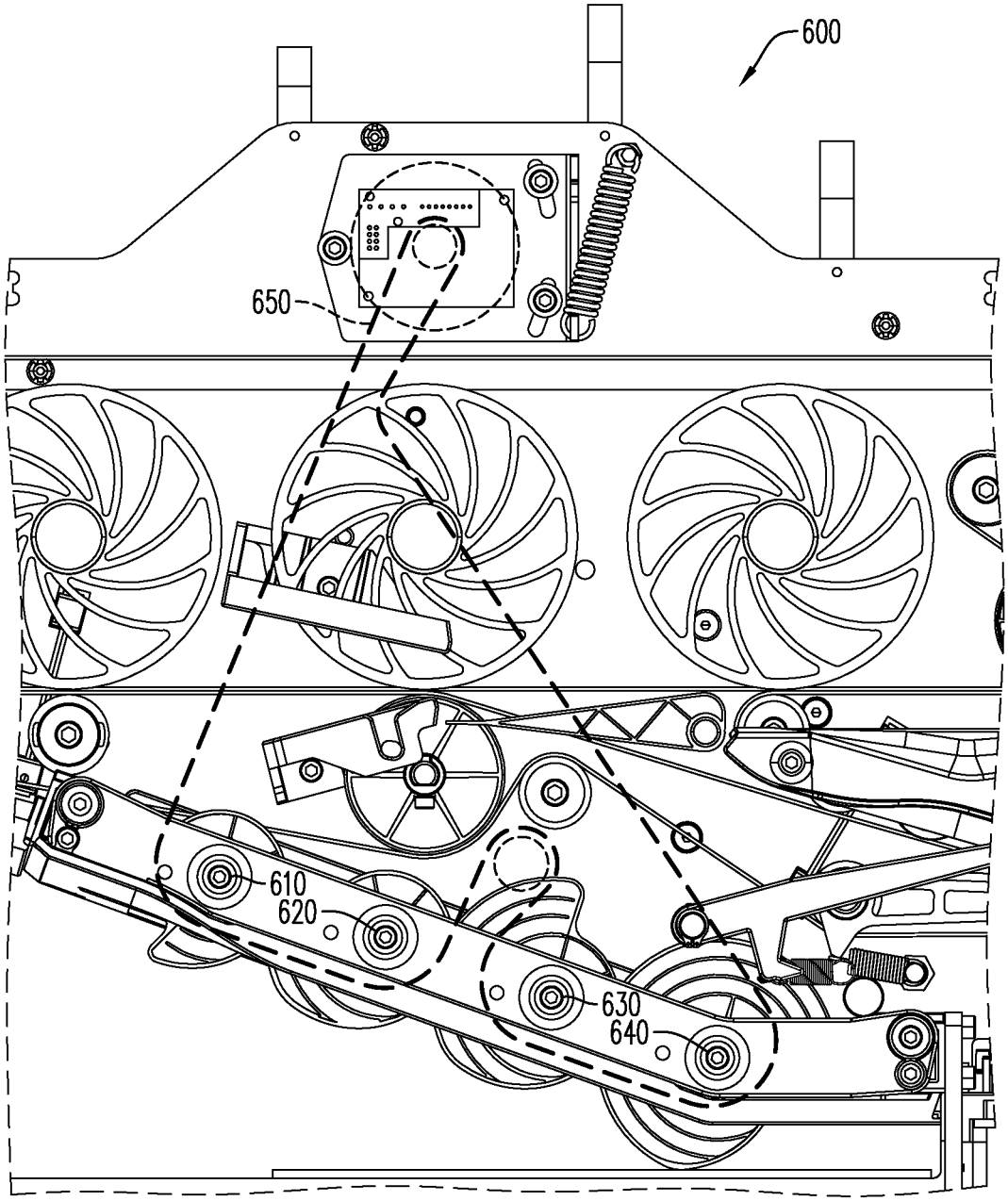
FIG. 6 is a top view illustrating a cam shaft driving mechanism in accordance with some embodiments.
Figure 7:
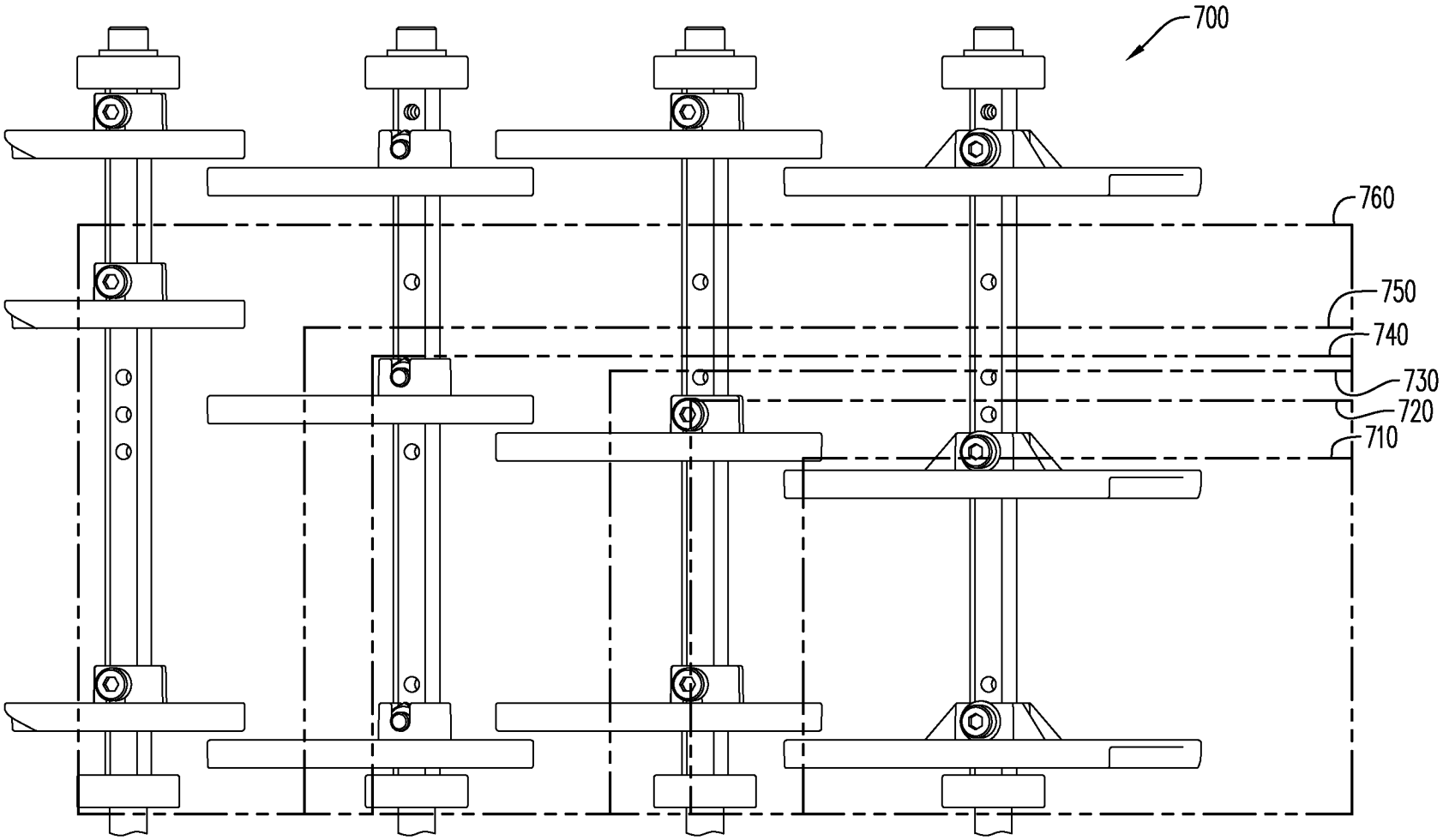
FIG. 7 illustrates a side view of various mail-piece sizes that may be associated with a cam stacking assembly according to some embodiments.

FIG. 6 is a top view 600 illustrating a cam shaft driving mechanism 650 (e.g., belt) in accordance with some embodiments. In this way, four cam shafts 610, 620, 630, 640 are all driven by the same motor and all have the same gear ratio to the motor. The cams may be timed to each other, according to some embodiments, using a special alignment tool. FIG. 7 illustrates a side view 700 of various mail-piece sizes that may be associated with a cam stacking assembly according to some embodiments. Note that the height of the different cams may change from right to left, matching the shape of commonly used envelopes. For example, FIG. 7 shows the cams arranged behind five (5) common U.S. envelope sizes along with a minimum size (710) of 3" by 5". The potential sizes that are illustrated include:

#6¼ (720) or 3.5" by 6",
#7 (730) or 3.75" by 6.75",
#9 (740) or 3.875" by 8.875",
#10 (750) or 4.125" by 9.5", and
#14 (760) or 5" by 11.5".

According to some embodiments, a minimum length of 5" (due to placement of the rightmost cam shaft relative to the registration wall), a maximum length: of 14" (due to the spacing of each stacker element in the machine), a minimum height of 3.5" (due to height of the center cam on the rightmost cam shaft), and a maximum height of 10" (due to height of the guide walls) may be supported along with a maximum thickness of approximately 10 to approximately 13 millimeters ("mm") (due to the spacing between opposing guides in the transport path).

Figure 8:
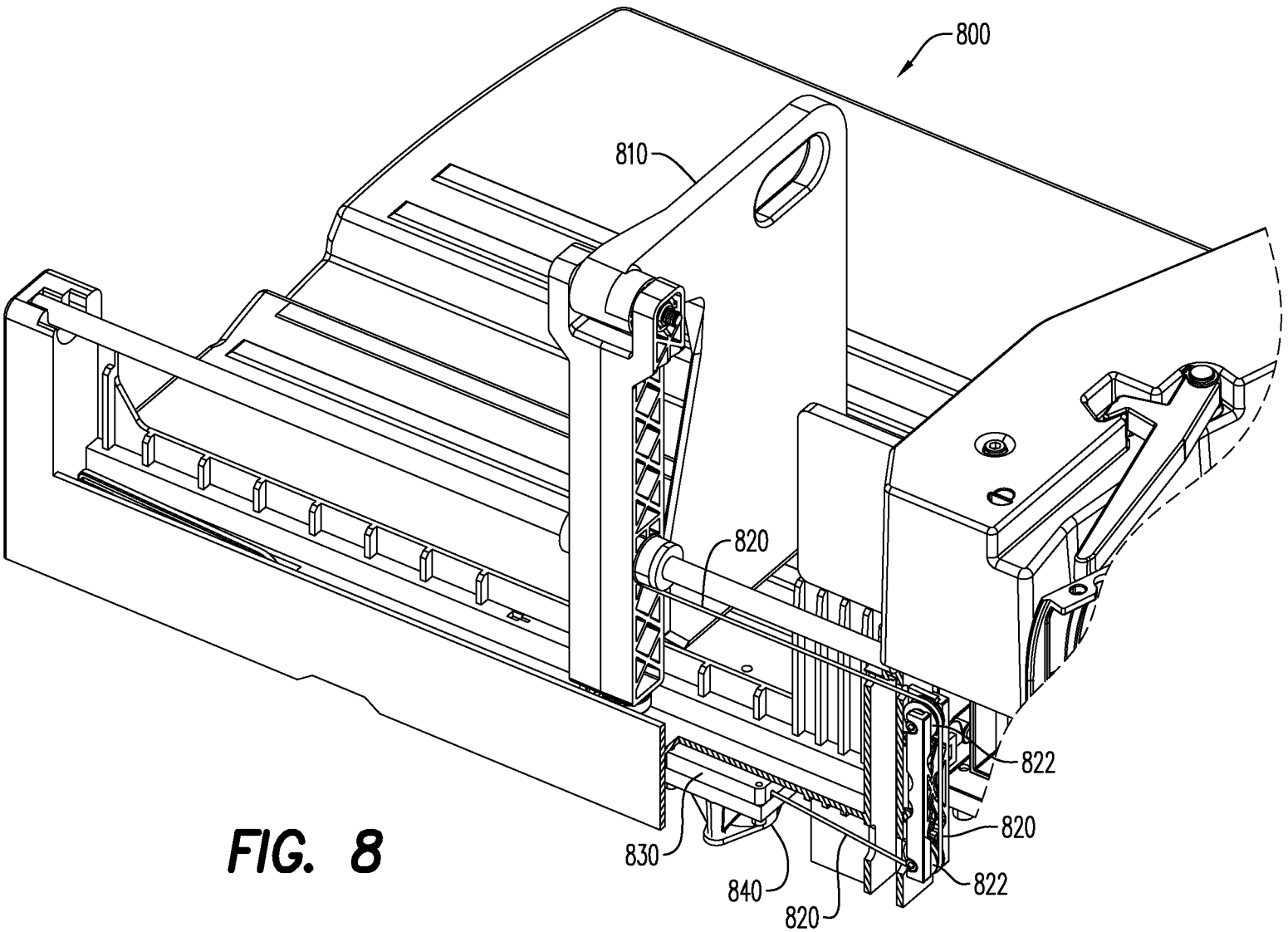
FIG. 8 illustrates a spring tensioned paddle for a sortation bin in accordance with some embodiments.
Figure 9:
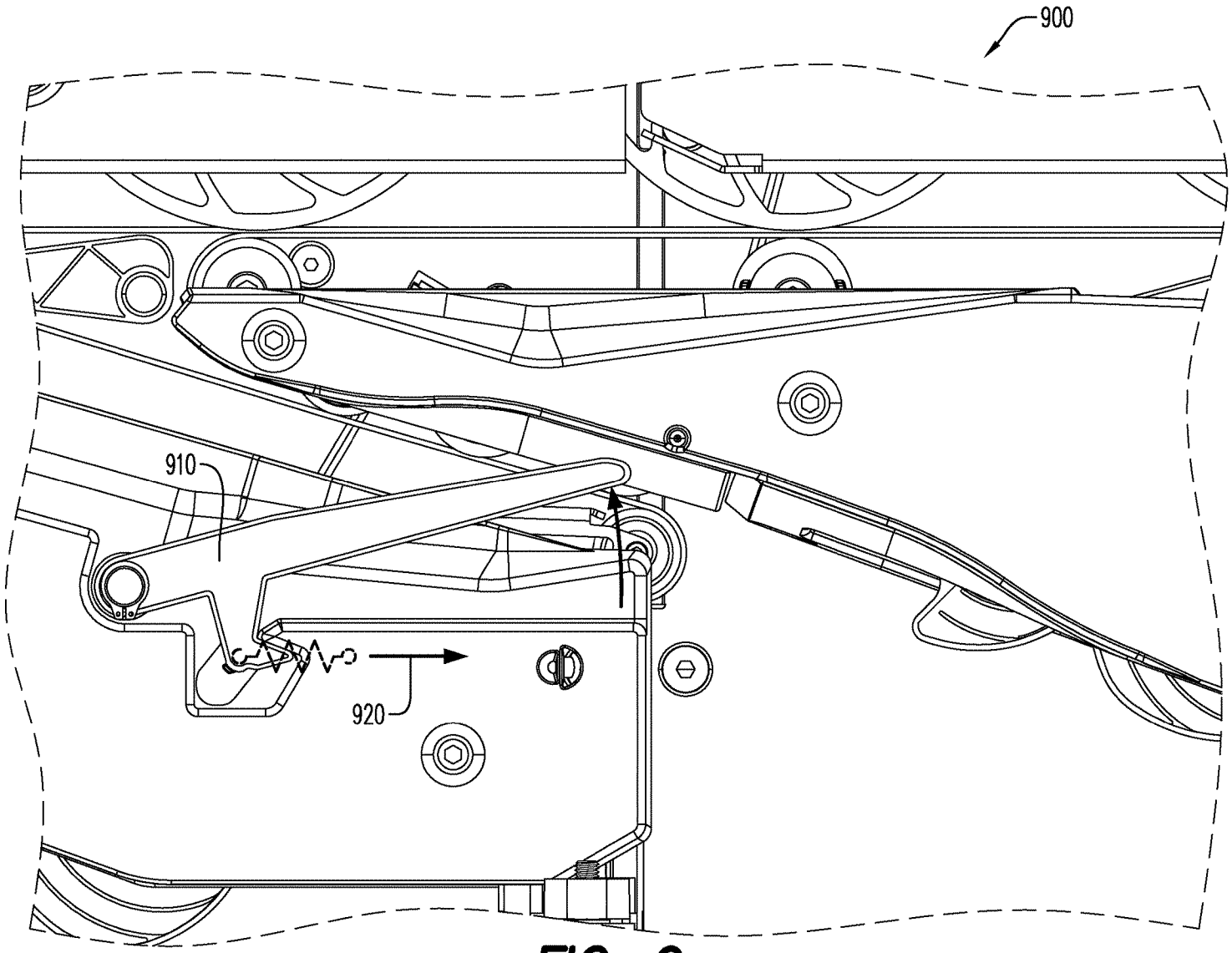
FIGS. 9 through 12B illustrate a spring finger to guide a mail-piece according to some embodiments.

Referring again to FIG. 5, recall that as mail 580 is stored into the sortation bin 560, the cam shafts 550 will gently push the mail causing the paddle wall or assembly 590 to move in a second direction perpendicular to the first direction. According to some embodiments, a dampening element may be provided to dampen motion of the sortation bin 560 paddle wall 590 in the second direction (e.g., to discourage relatively large and/or sudden movement of the paddle wall 590). For example, FIG. 8 illustrates 800 a spring tensioned paddle for a sortation bin in accordance with some embodiments. In particular, the mail stack is contained by a paddle assembly 810. This paddle assembly 810 has a spring 830 tensioned retractor wire 820 which provides force to keep the mail stack from falling over. A dahspot is also used to provide resistance to the paddle assembly 810. A dashpot is a damper 840 which resists motion through the use of viscous friction. It may, according to some embodiments, provide a resistive force proportional to the velocity of the paddle assembly.

Figure 10:
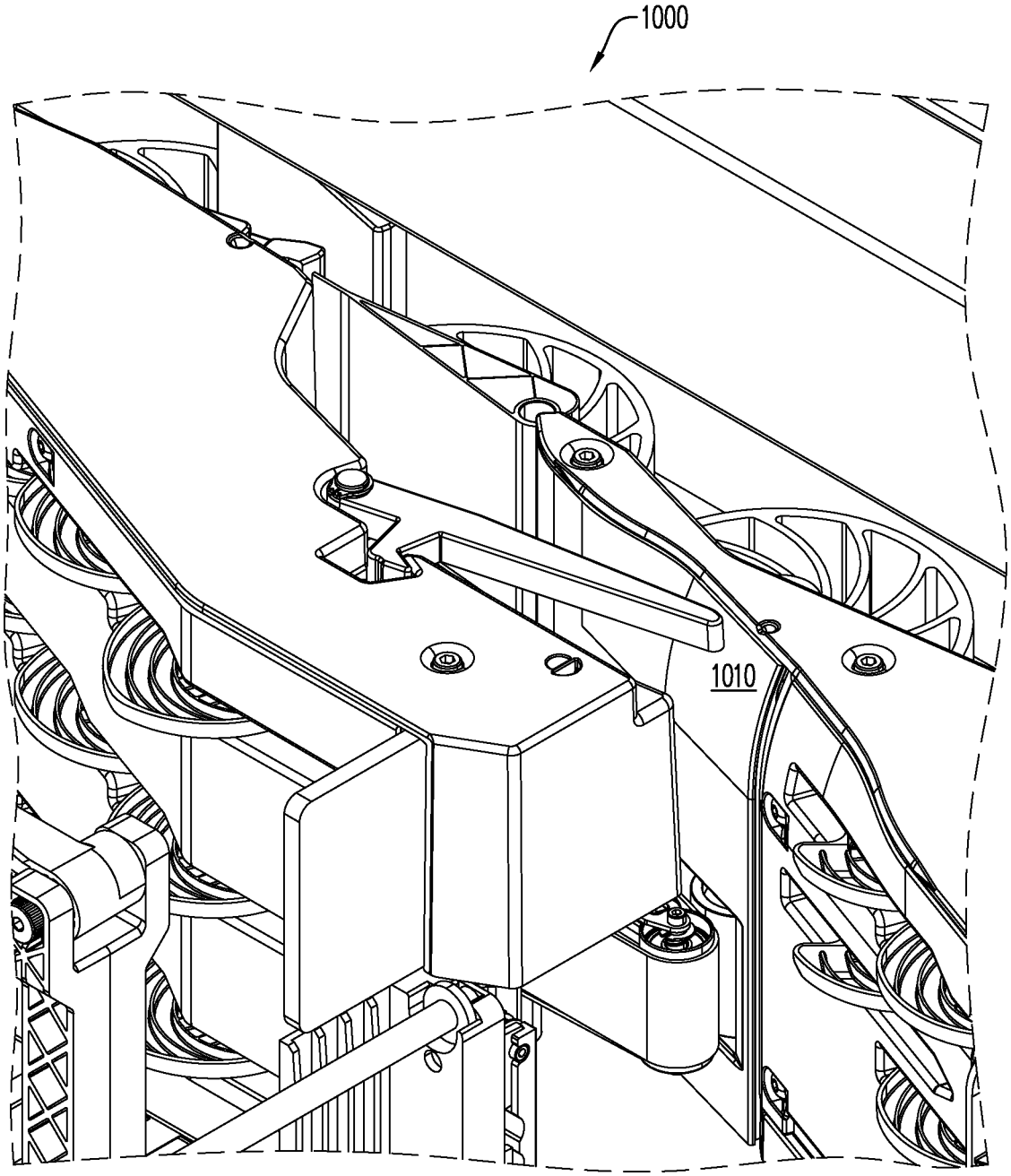

According to some embodiments, a cam spring arm top finger may be provided to help prevent the leading edge of an incoming mail-piece from colliding with a trailing edge of a previously accepted mail-piece. For example, FIGS. 9 through 12B illustrate a spring finger to guide a mail-piece according to some embodiments. As illustrated 900 in FIG. 9, a spring arm 910 with a direction of spring force 920 may be used for thin mail (less than approximately 1 or approximately 2 mm) that is above approximately 7" in height. As illustrated in FIG. 10, a spring arm might be used to prevent a leading edge to trailing edge crashes on the part of the mail that is above the cams, since they only have a max height of 5.8". The spring finger may actually slightly fold the incoming mail-piece over around the top of the cam wall cover 1010.

Figure 11B:
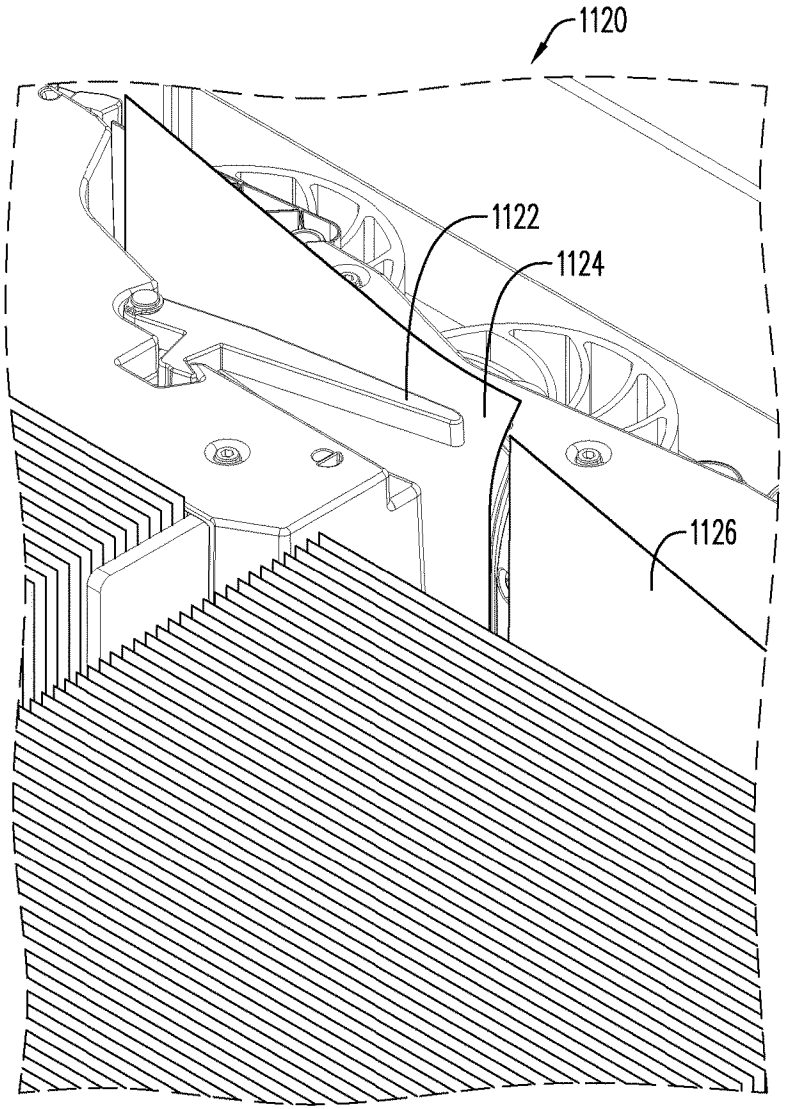
Figure 11A:
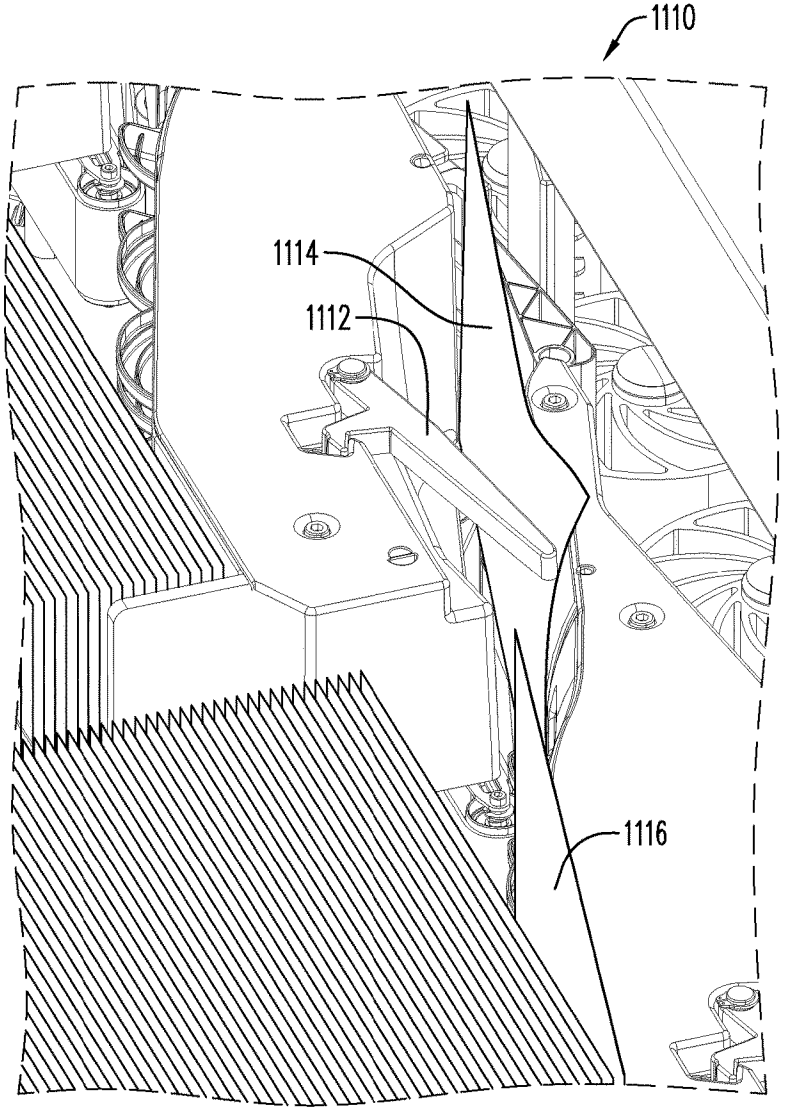
Figure 12B:
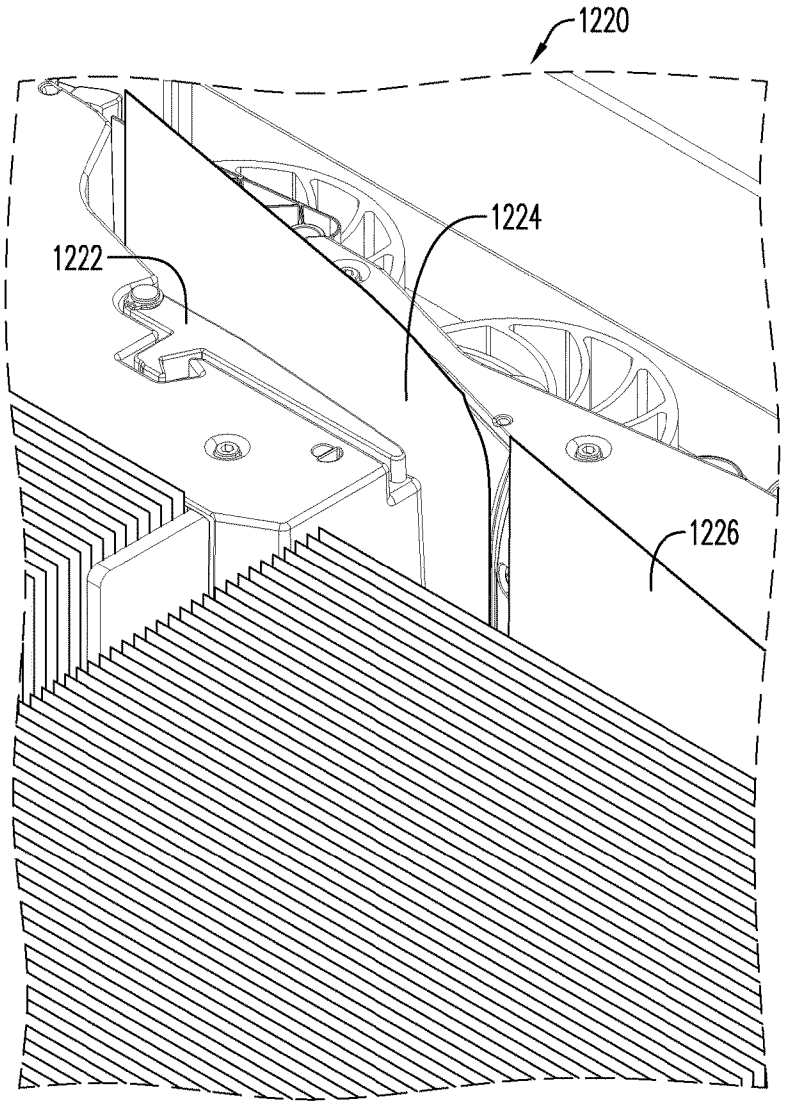
Figure 12A:
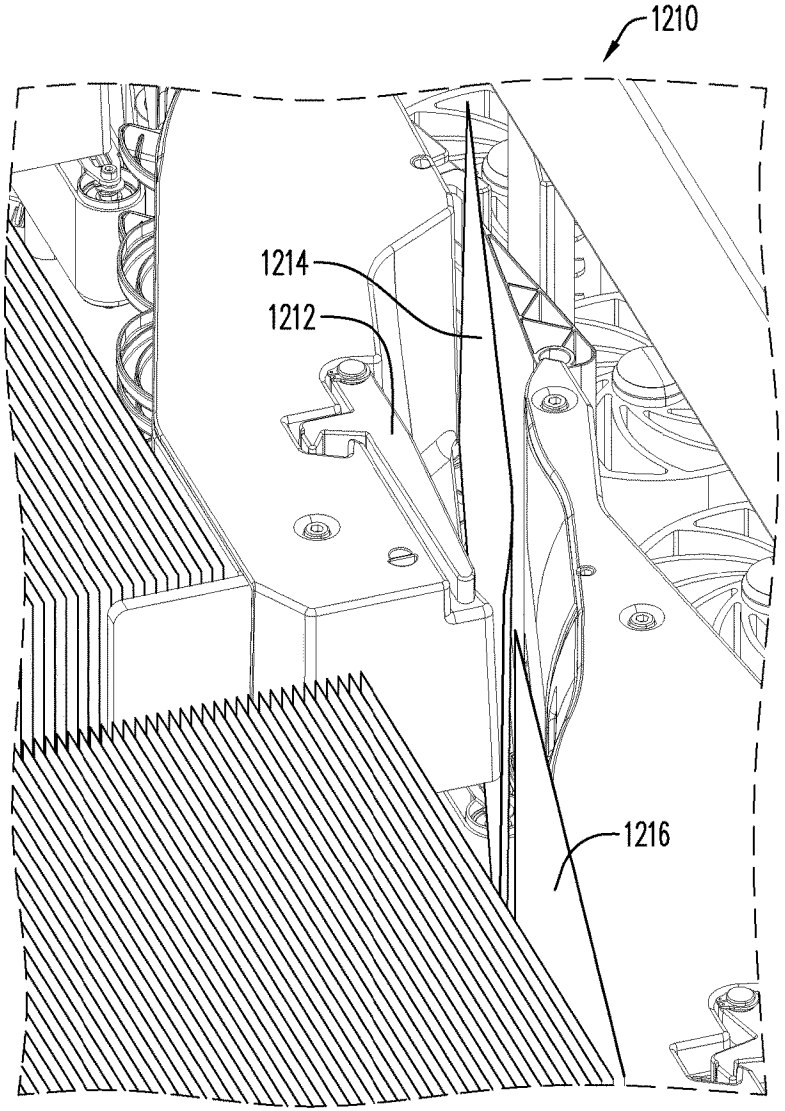

As illustrated in FIGS. 11A and 11B, with a spring finger 1112, 1122 the incoming mail piece 1114, 1124 may be pushed behind a previously stacked mail-piece 1116, 1126. As illustrated in FIGS. 12A and 12B, without the spring finger 1212, 1222 the incoming mail-piece 1214, 1224 might curl in front of the previously stacked piece 1216, 1226 resulting in a crash (and potentially damage to the mail-pieces 1214, 1224, 1216, 1226 and/or a machine jam.

According to some embodiments, a stacking assembly may have the cam shafts linked together so as to rotate in a sequential manner such that: (i) a path into the registration all opens up just in time for the leading edge of a mail-piece to pass through, (ii) the cams continue to rotate to help a tail end of the envelope into place, and (iii) at least one cam then generally provides force in the second direction on a stack of previously accepted mail-pieces in the sortation bin. For example, FIGS. 13 through 18 illustrate the synchronized rotation of cam shafts as a mail-piece travels past the cam stacking assembly in accordance with some embodiments.

Figure 13:
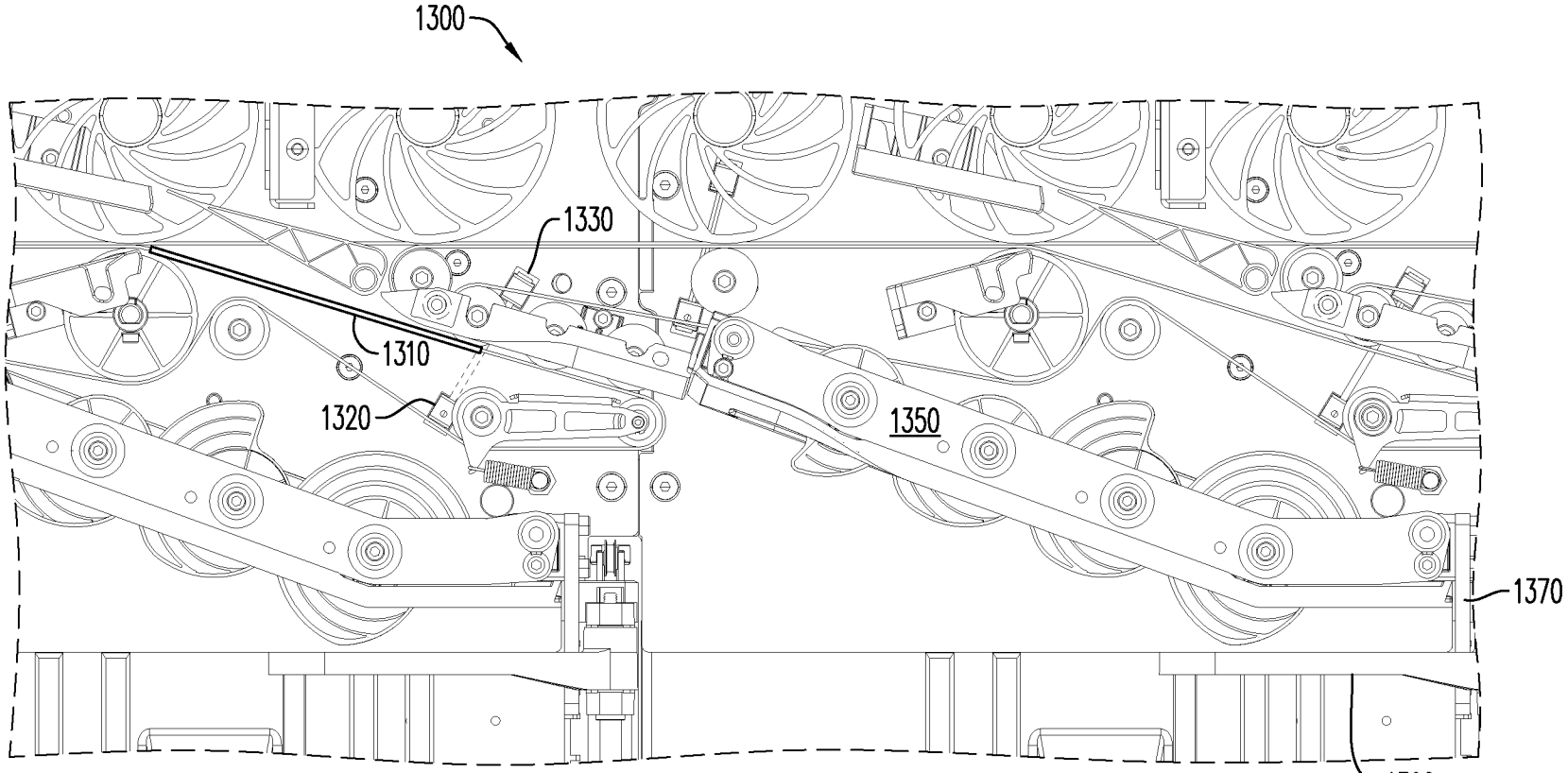
FIGS. 13 through 18 illustrate the synchronized rotation of cam shafts as a mail-piece travels past the cam stacking assembly in accordance with some embodiments.
Figure 14:
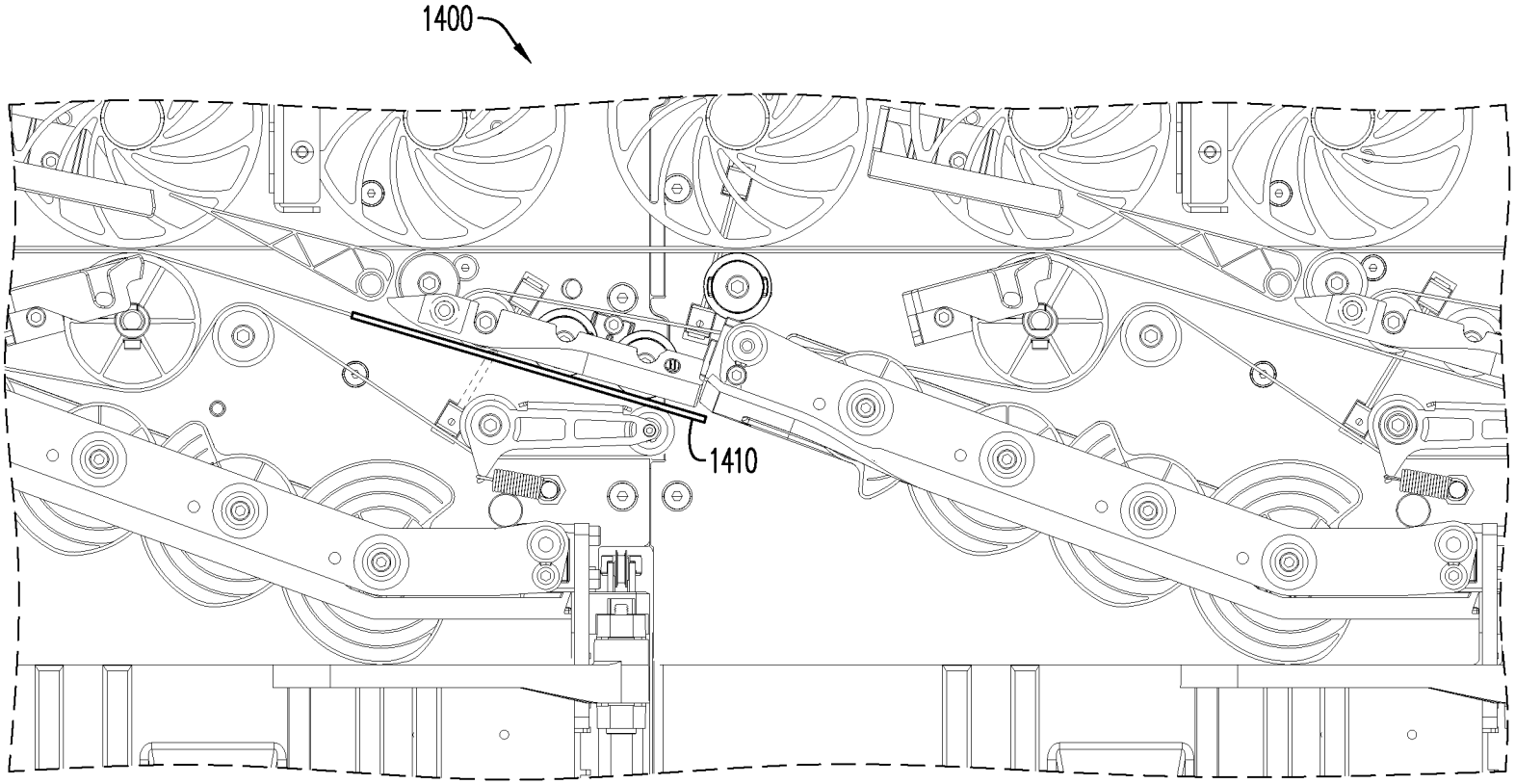
Figure 15:
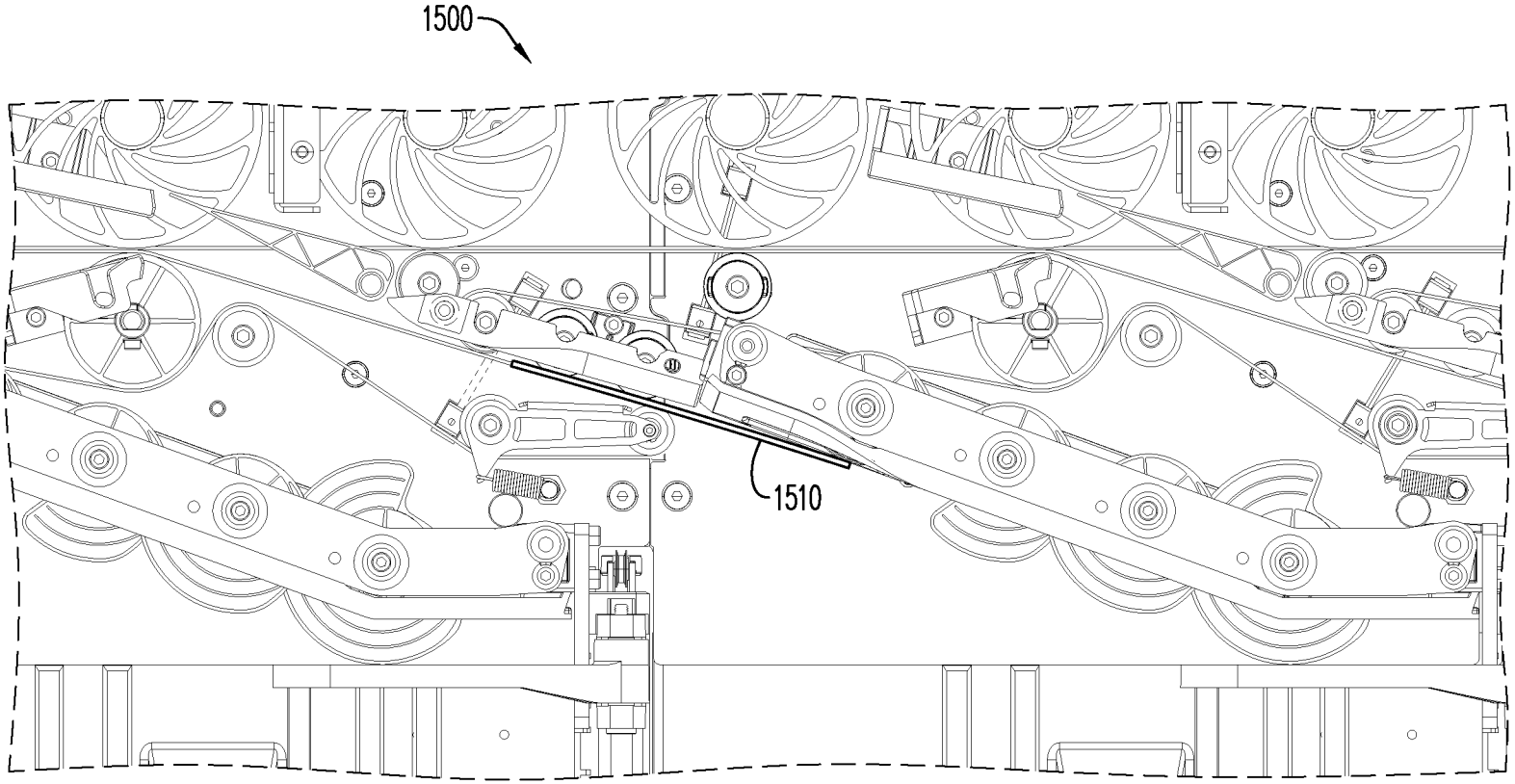
Figure 16:
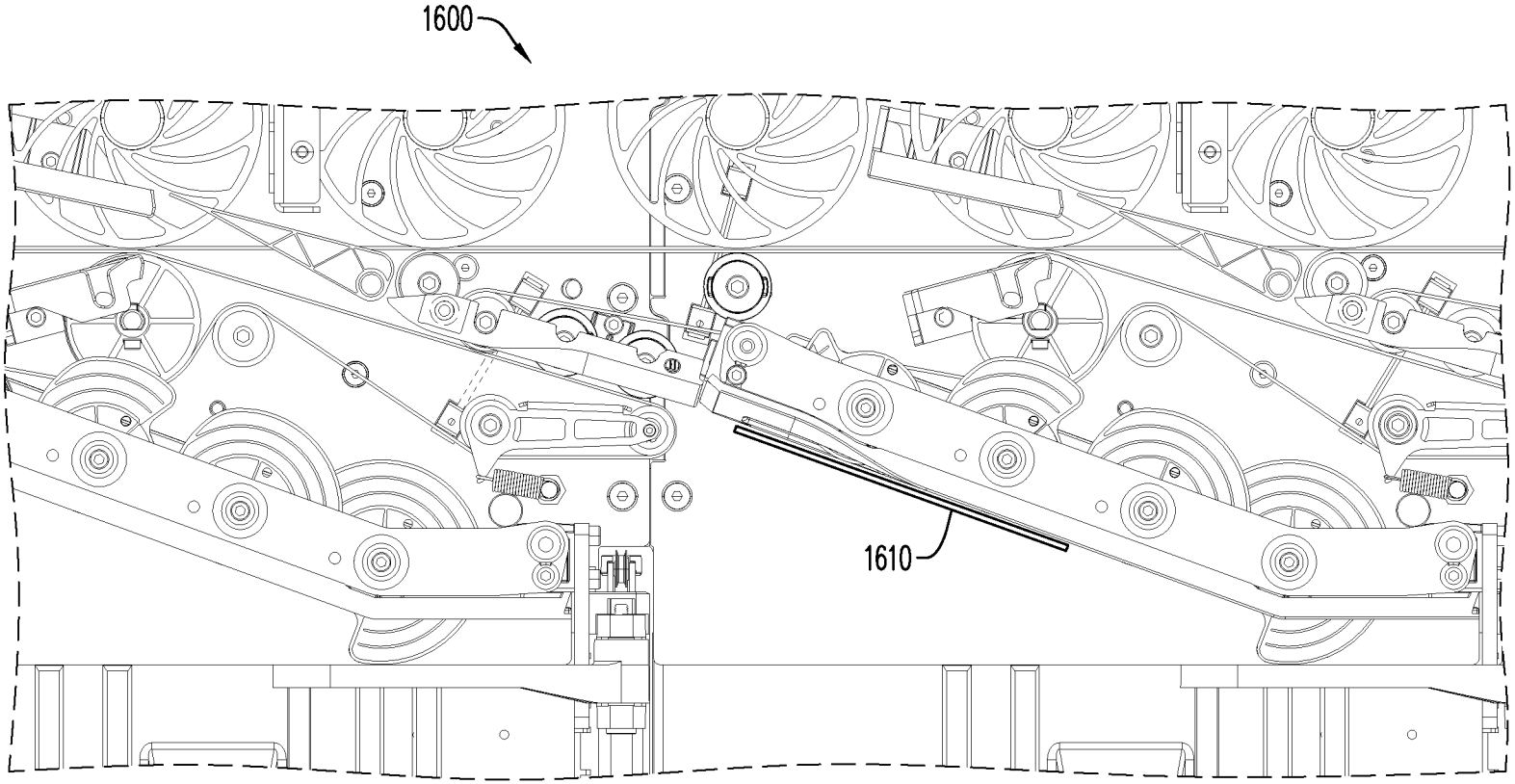
Figure 17:
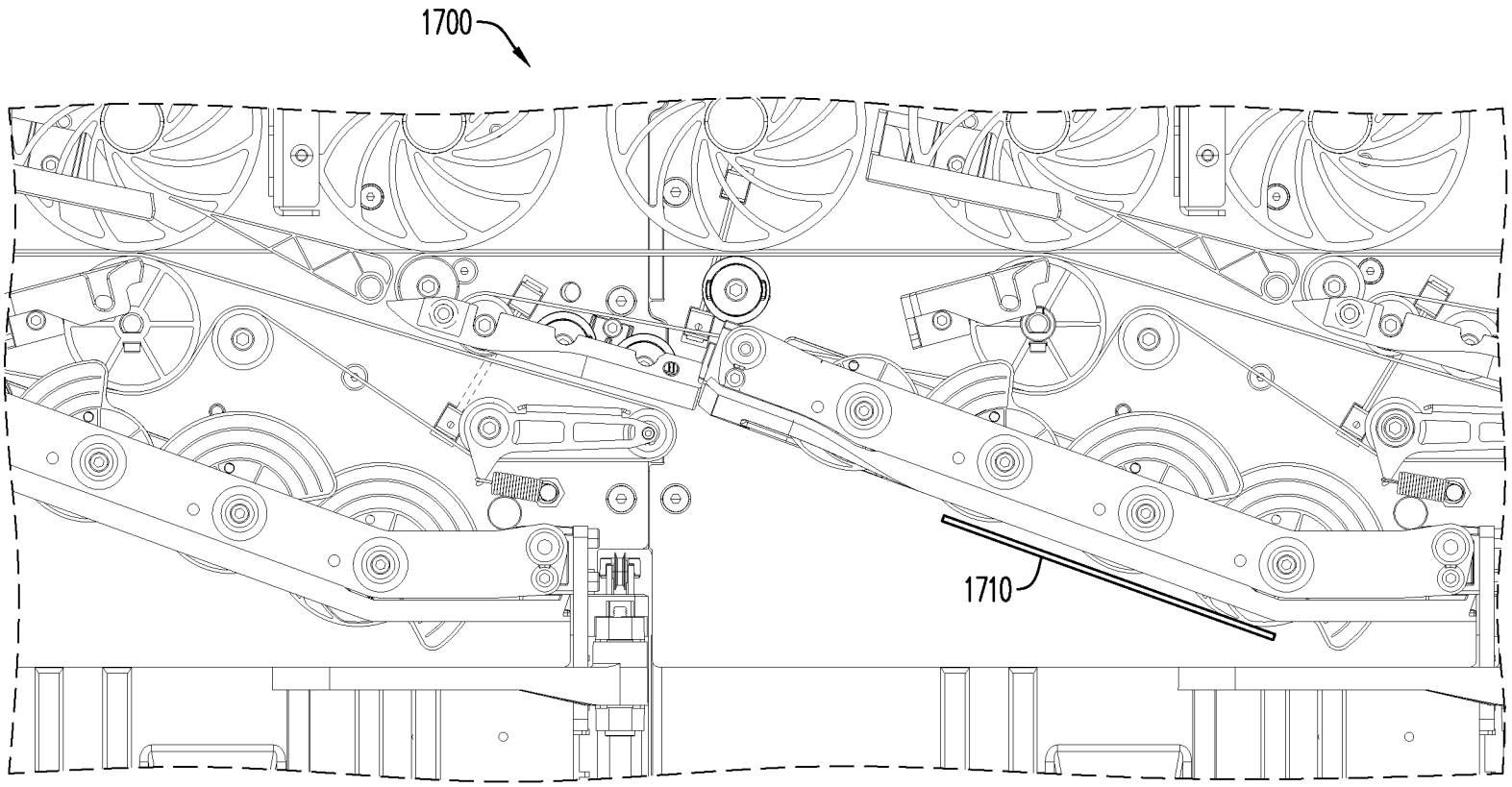
Figure 18:
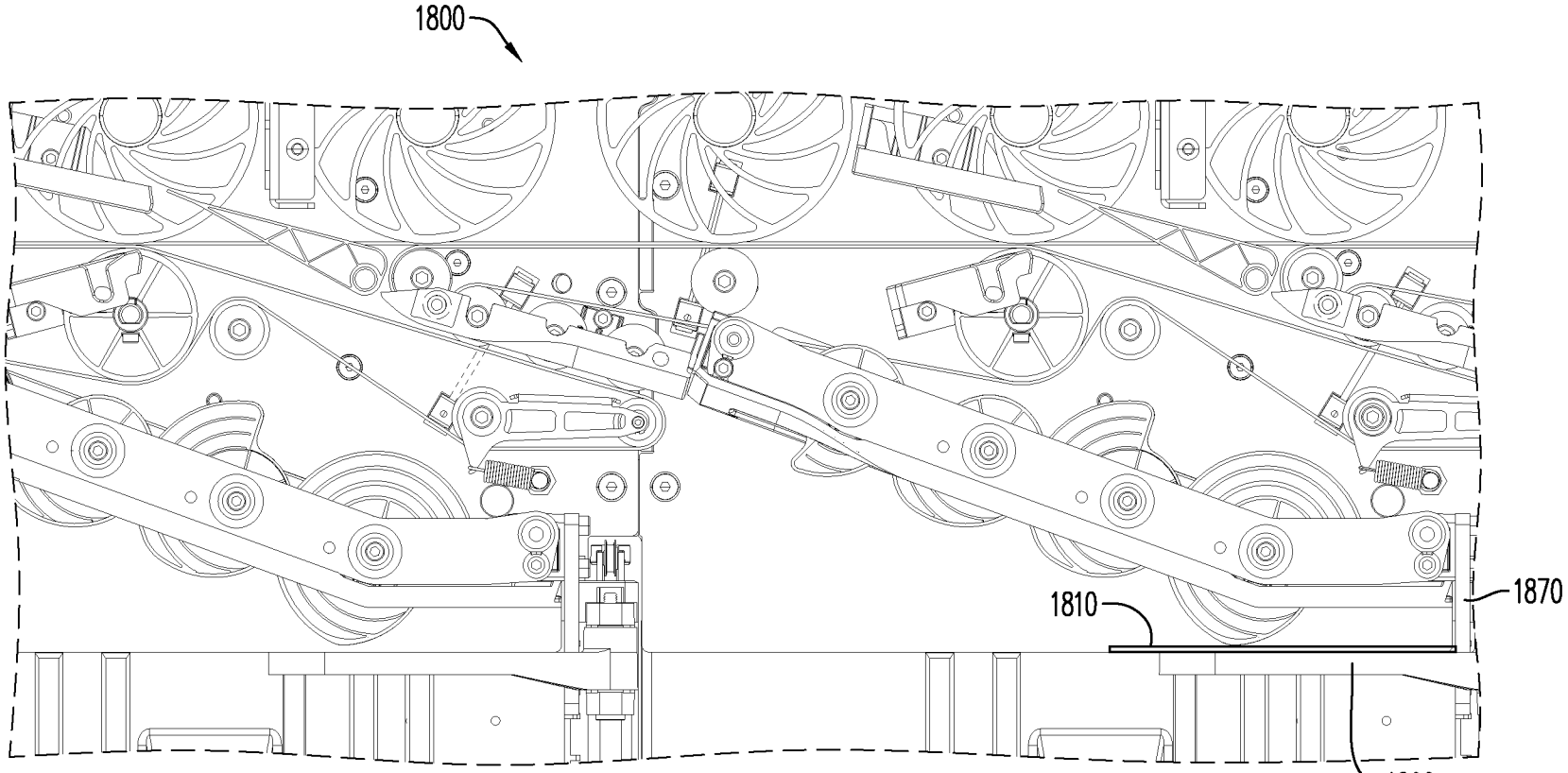

As illustrated 1300 in FIG. 13, an envelope 1310 travels down the stacker transport at a fixed velocity and will block a sensor beam transmitted from a beam source 1320 to a beam sensor 1330. The sensor beam blockage will trigger the cams 1350 to start moving in a counterclockwise direction which will let the envelope travel to a registration wall 1330 and move the mail stack (e.g., pushing away a paddle assembly 1390). As illustrated 1400 in FIG. 14, the mail-piece 1410 will continue to move down the transport as the cams accelerate up to their desired velocity of 5200 degrees/second ("deg/s") for 65 degrees of displacement. Once the cams hit their desired velocity as pictured 1500 in FIG. 15, they will continue processing the envelope 1510 at that speed until 295 degrees. As the cams rotate, they move out of the way of the incoming mail-piece 1610 as shown 1600 in FIG. 16. The mail-piece 1610 eventually will exit the belts transporting it and will travel to the registration wall using only its own momentum. In the example 1700 of FIG. 17, the cams have reached 295 degrees of displacement while processing the mail piece 1710. This is when the cam stacker will decide to stop if no new mail-piece is incoming, or to intercept to accept the next incoming mail-piece. As illustrated 1800 in FIG. 81, the final cam pinches the mail-piece 1810 and pushes it out against the paddle or stack 1890 as the mail piece reaches the registration wall 1870.

Figure 19:
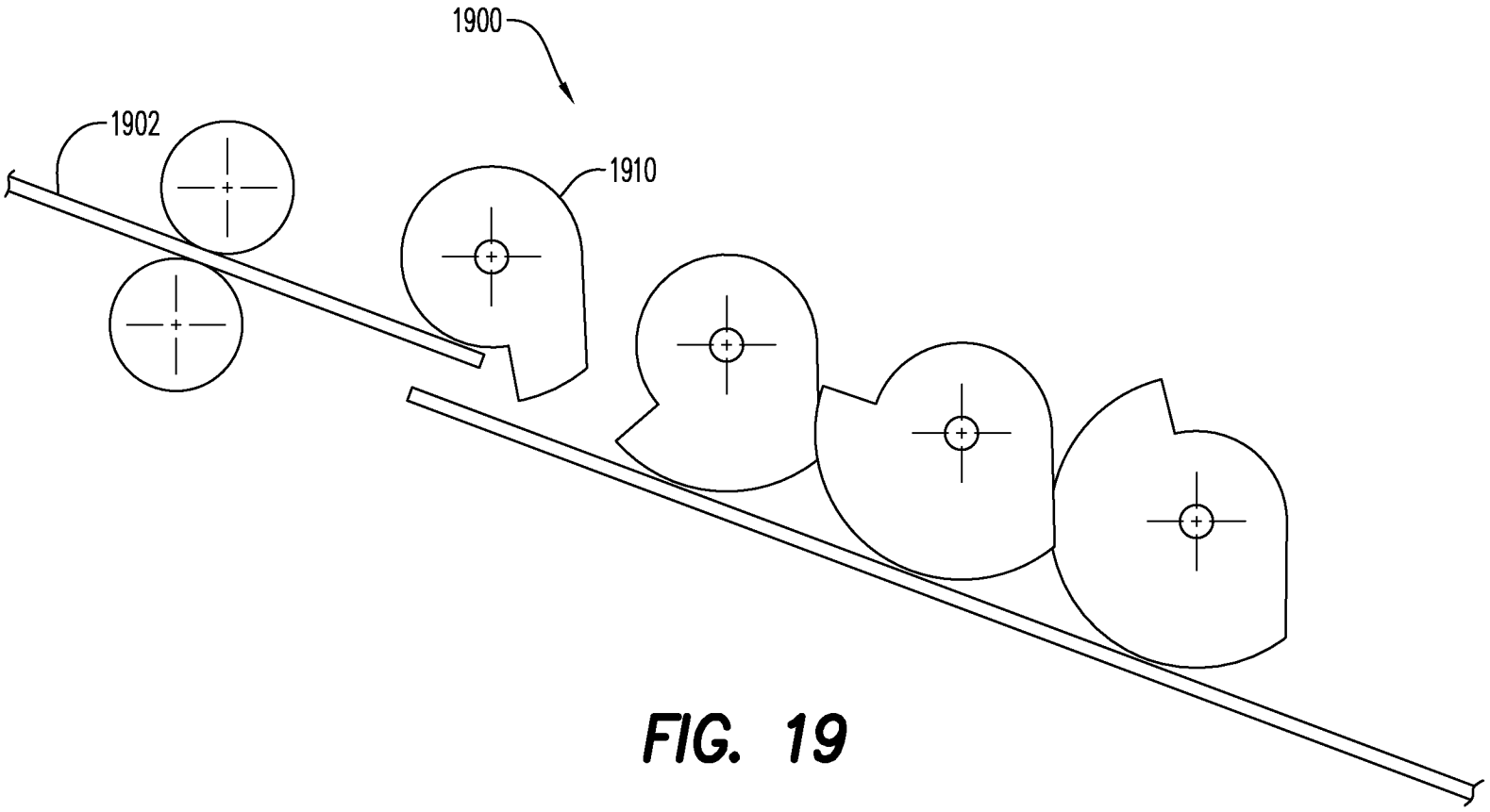
FIGS. 19 through 25 show mail-piece position just before it reaches each camshaft according to some embodiments.
Figure 20:
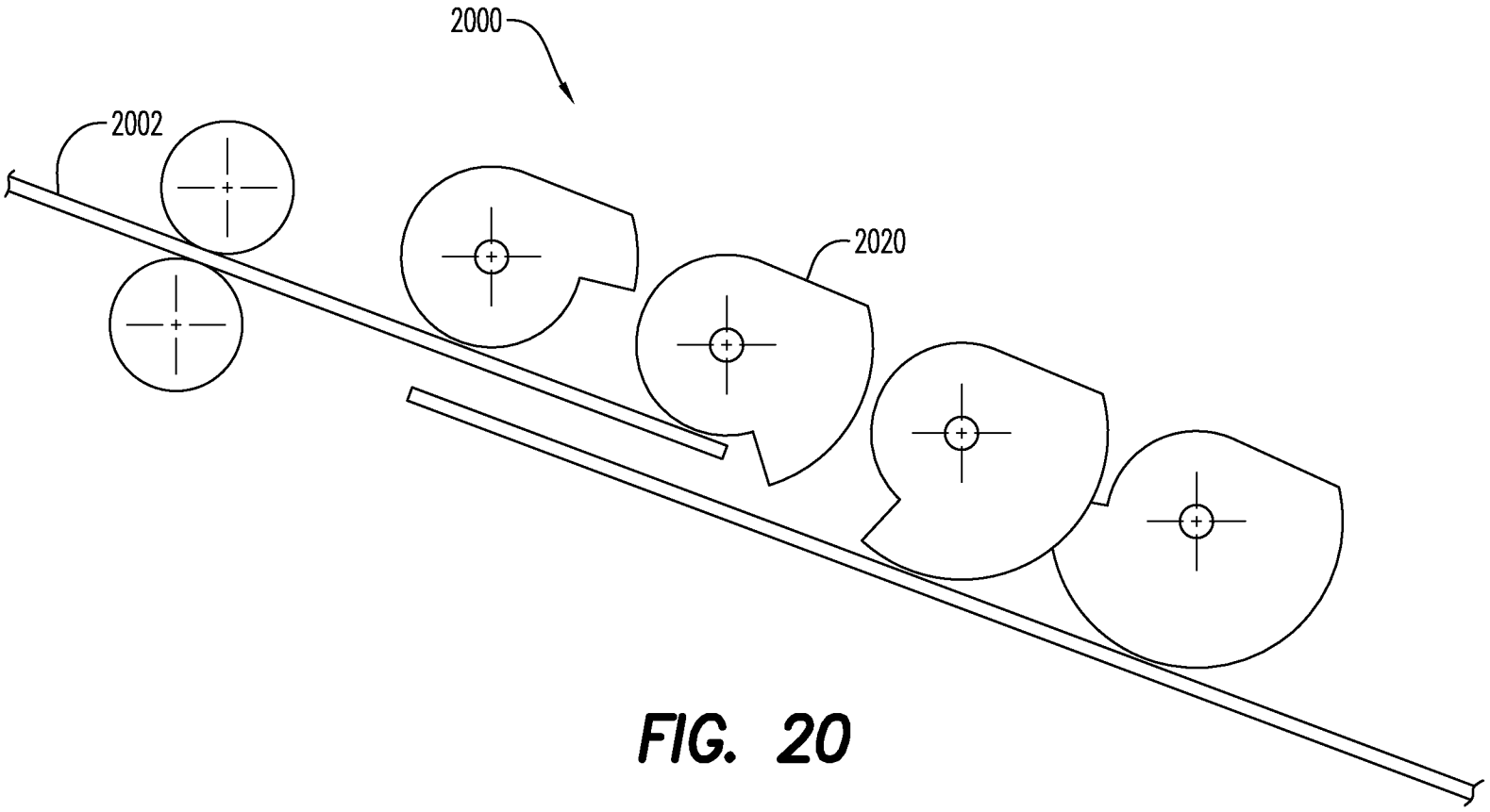
Figure 21:
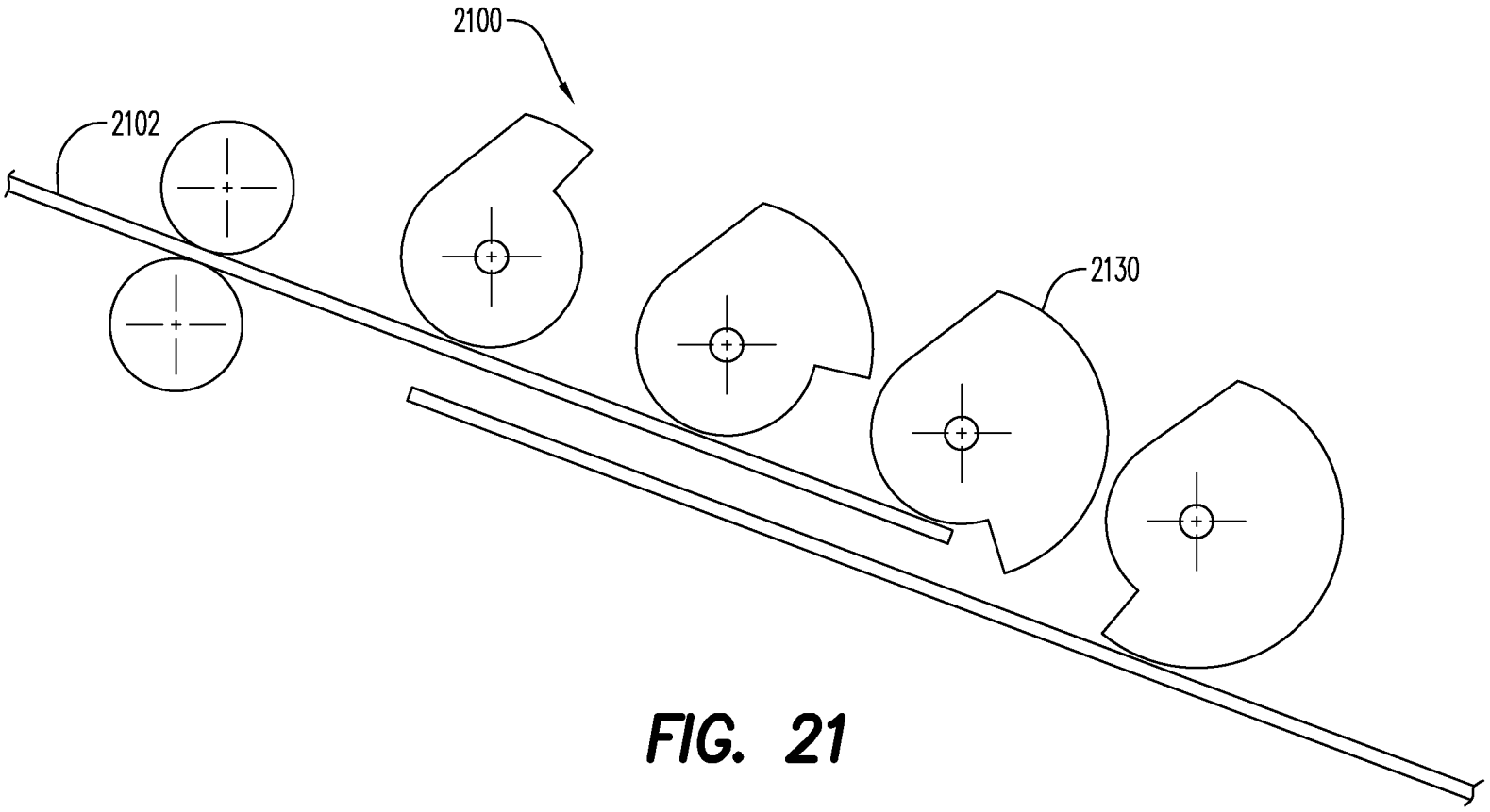
Figure 22:
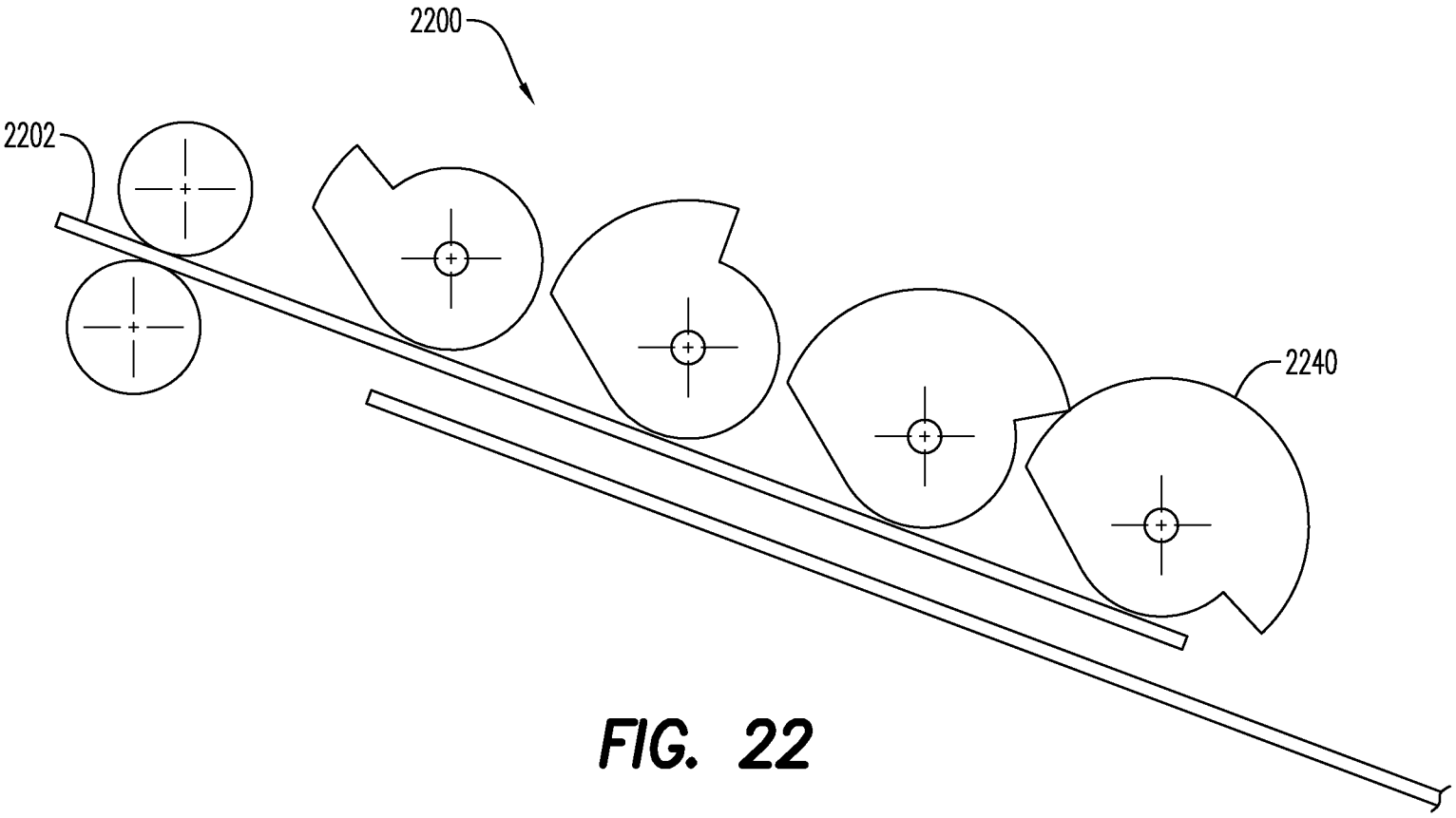
Figure 23:
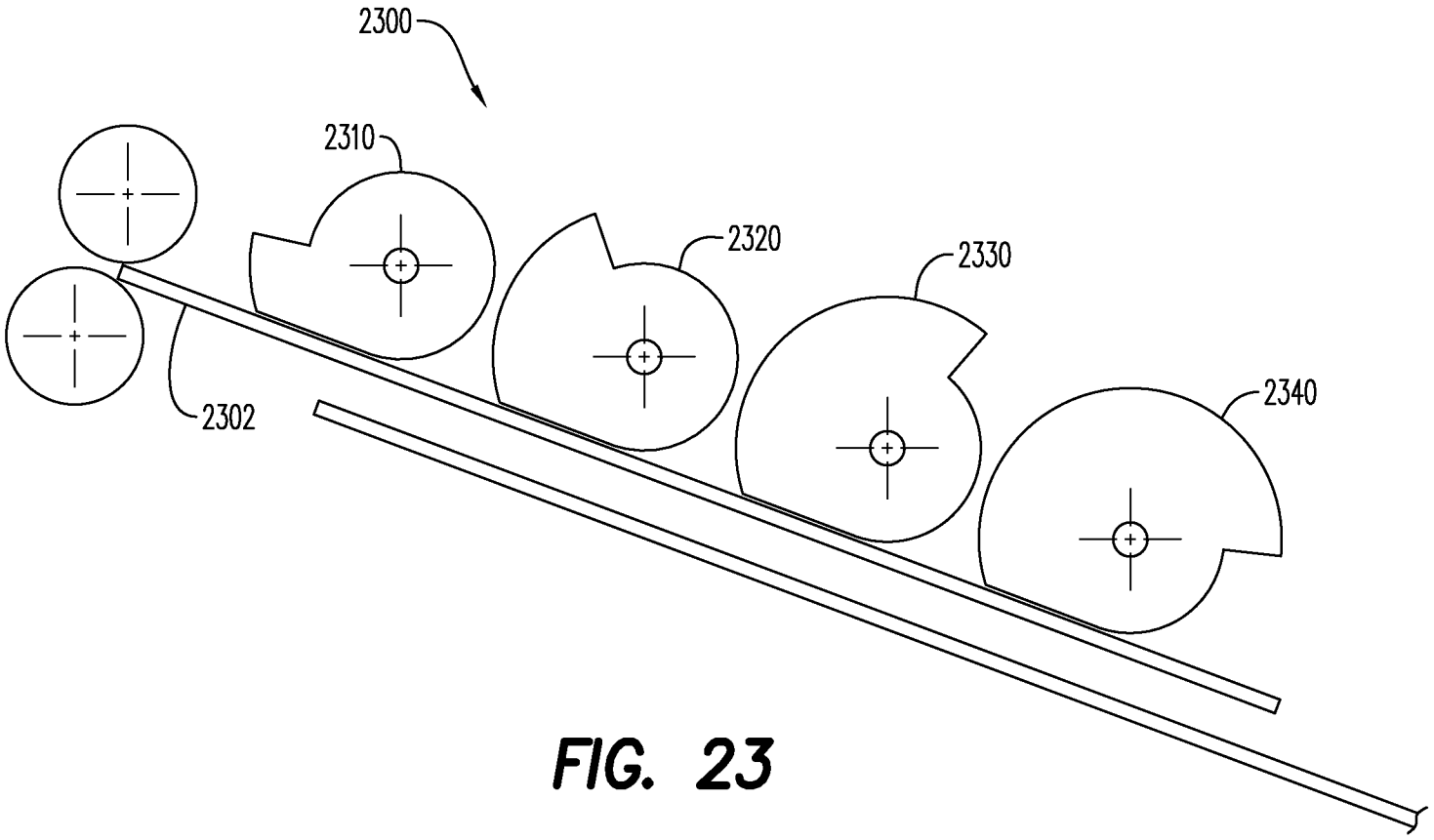
Figure 24:
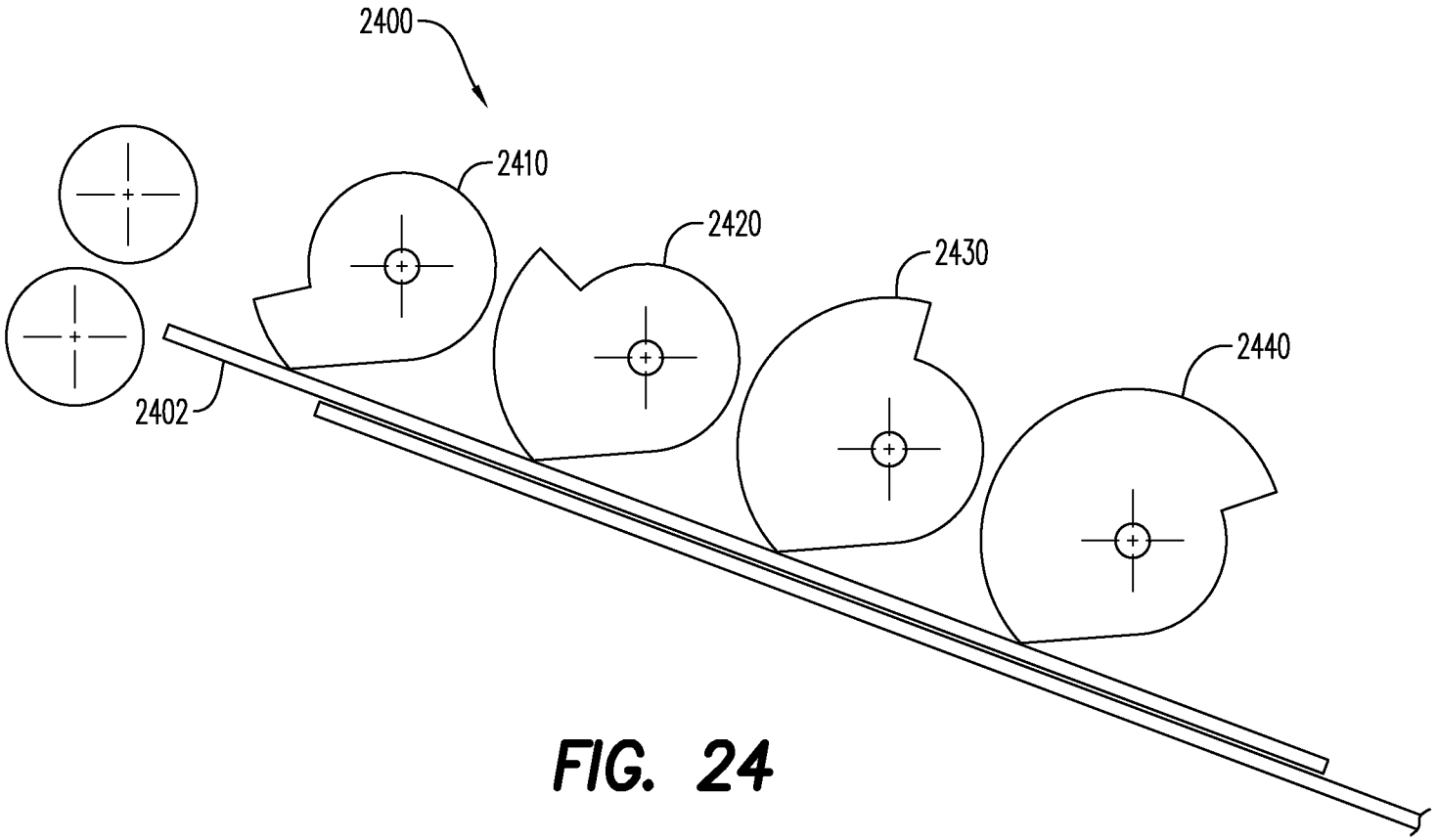
Figure 25:
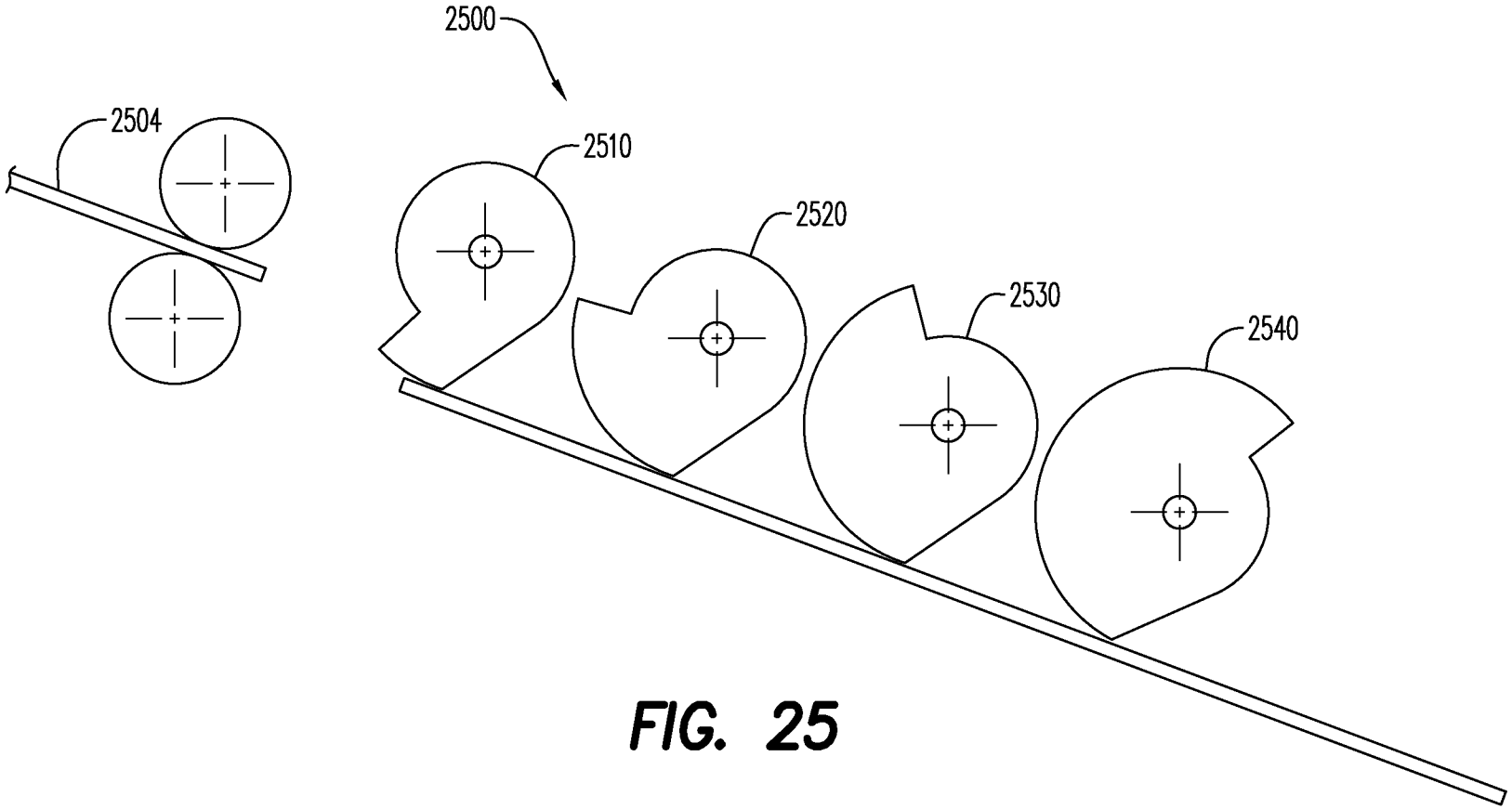

FIGS. 19 through 25 show mail-piece position just before it reaches each camshaft according to some embodiments. According to some embodiments, the motion profile of the cams is designed such that the hooks of the cams lead a mail-piece into the stack of mail. In particular, FIG. 19 shows 1900 a mail-piece 1902 at a first cam 1910 in accordance with some embodiments. FIG. 20 shows 2000 a mail-piece 2002 at a second cam 2020, and FIG. 21 shows 2100 a mail-piece 2102 at a third cam 2130. FIG. 22 shows 2200 a mail-piece 2202 reaching a fourth cam 2240, and FIG. 23 shows 2300 a mail-piece 2302 past a fourth cam 2340 and about to be "kicked" (and as can be seen, all of the cams 2310, 2320, 2330, 2340 engage the mail-piece 2302). FIG. 24 shows 2400 cams 2410, 2420, 2430, 2440 midway through "kicking" a mail-piece 2402, and FIG. 25 shows 2500 cams 2510, 2520, 2530, 2540 after the mail-piece is fully "kicked" out and the system awaits the next mail-piece 2504.

According to some embodiments, a beam detector may generate a trigger signal when a beam is blocked by a leading edge of an incoming mail-piece. A controller, operatively coupled to cam shafts, may then initiate rotation of the cam shafts upon receipt of the trigger signal. For example, the controller may alter rotation of the cam shafts in accordance with a calculated "intercept motion profile." FIGS. 19 through 23 are example intercept profiles showing cam shaft velocity over time in connection with a cam stacking assembly according to some embodiments. As used herein, the phrase "intercept motion profile" may refer to a type of velocity motion profile with the following characteristics:

- one acceleration and one deceleration;
- equal acceleration rate and deceleration rate;
- known variables include: initial velocity (measured), final velocity (given), initial position (measured), final position (given), initial time (measured), and final time (given); and
- unknown variables include (and thus need to be calculated): acceleration rate (same as deceleration rate), and peak velocity.

According to some embodiments, a nominal cam velocity of 5,200 deg/sec will causes the hooks of each of the four (4) different cams to "hide" behind the wall just before the leading edge of a mail-piece reaches it when the transport is running at 180 in/sec. For slower belt velocities, the nominal cam velocity may scale down linearly with belt speed.

Figure 26:
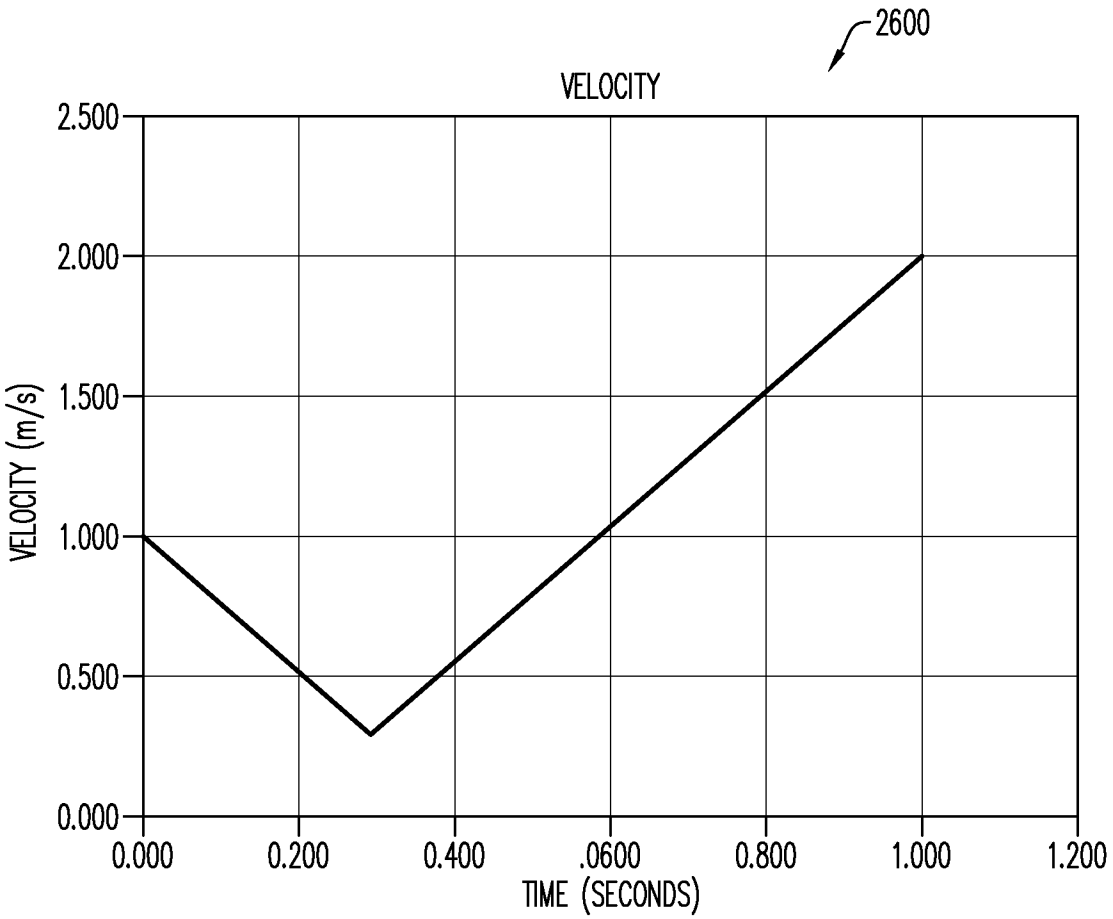
FIGS. 26 through 30 are example intercept profiles showing cam shaft velocity over time in connection with a cam stacking assembly according to some embodiments.

FIG. 26 illustrates a graph 2600 for an intercept motion profile with the following known values:

Initial Velocity=1 m/s
Final Velocity=2 m/s
Initial Position=0 m
Final Position=1 m
Initial Time=0 s
Final Time=1 s The calculated values are:

Acceleration Rate=2.414 $m/s^2$
Peak Velocity=0.293 m/s.

According to some embodiment, a cam stacker may perform different motion profiles depending on the pitch of the incoming mail-pieces. For all of the following examples, two mail-pieces are being stacked at varying pitch. Since the cams are a rotary axis, cycle position will be used to describe their position. This refers to the angle, from 0 to 360 degrees, in which they are at relative to their starting position.

Figure 27:
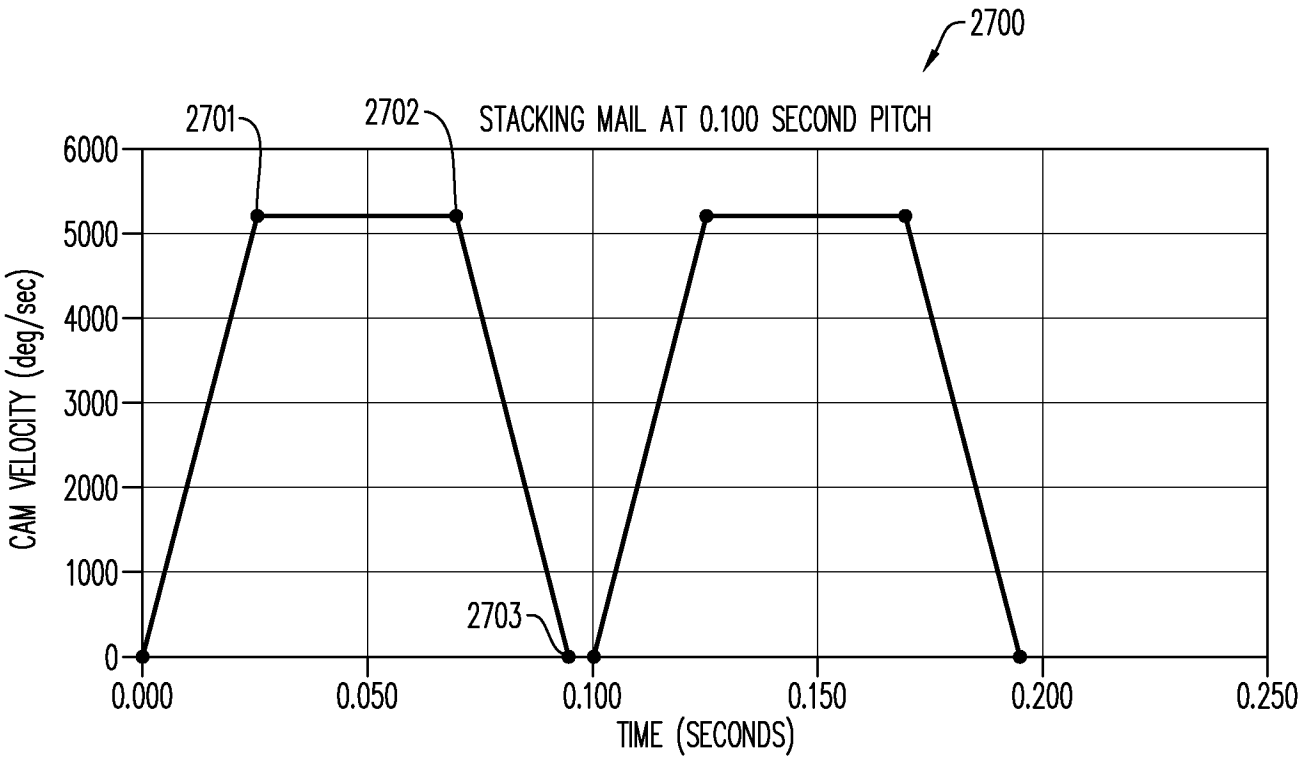

If the mail pitch is large enough, two separate, but same, motion profiles will occur as illustrated by the graph 2700 in FIG. 27. At 2701, acceleration is complete, the velocity is 5,200 degrees/sec, and the cycle position is 65 degrees. At 2702, the constant velocity is complete, the velocity is 5,200 degrees/sec, and the cycle position is 295 degrees. At 2703, the deceleration is complete, the velocity is 0 degrees/sec, and the cycle position: 360 degrees.

Figure 28:
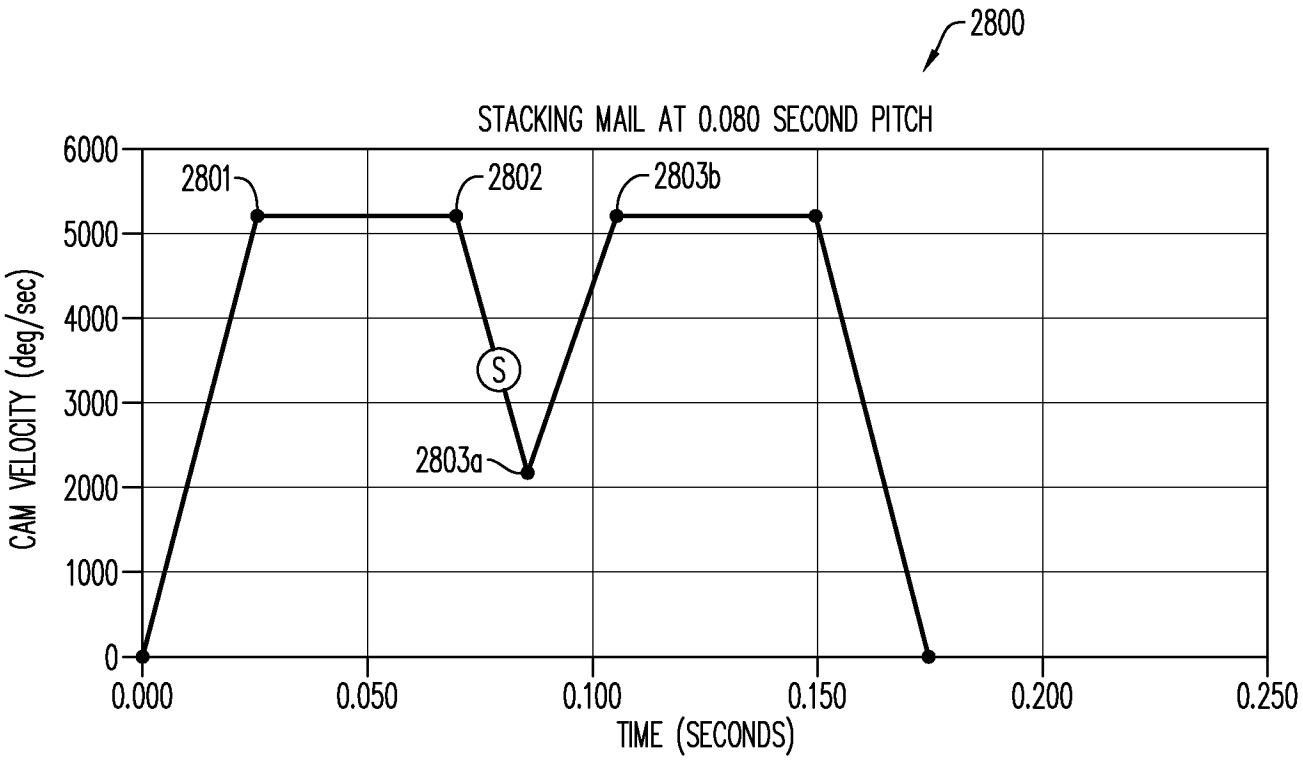

If the mail-pitch is smaller, the motion profiles will be combined. As illustrated by the graph 2800 of FIG. 28, the "through beam" sensor is struck by the second mail-piece at location "S," during the deceleration portion of the first motion profile. This results in an intercept profile to get back to a 65 degree cycle position. At 2801, acceleration is complete, velocity is 5,200 degrees/sec, and the cycle position is 65 degrees. At 2802, the constant velocity is complete, the velocity is 5,200 degrees/sec, and the cycle position is 295 degrees. The sensor is hit at location "S" in FIG. 28, and the controller may begin intercept to 65 degrees. In particular, at 2803*a* the first portion of intercept complete. At 2803*b*, the second portion of intercept complete, velocity is 5,200 degrees/sec, and the cycle position is 65 degrees.

Figure 29:
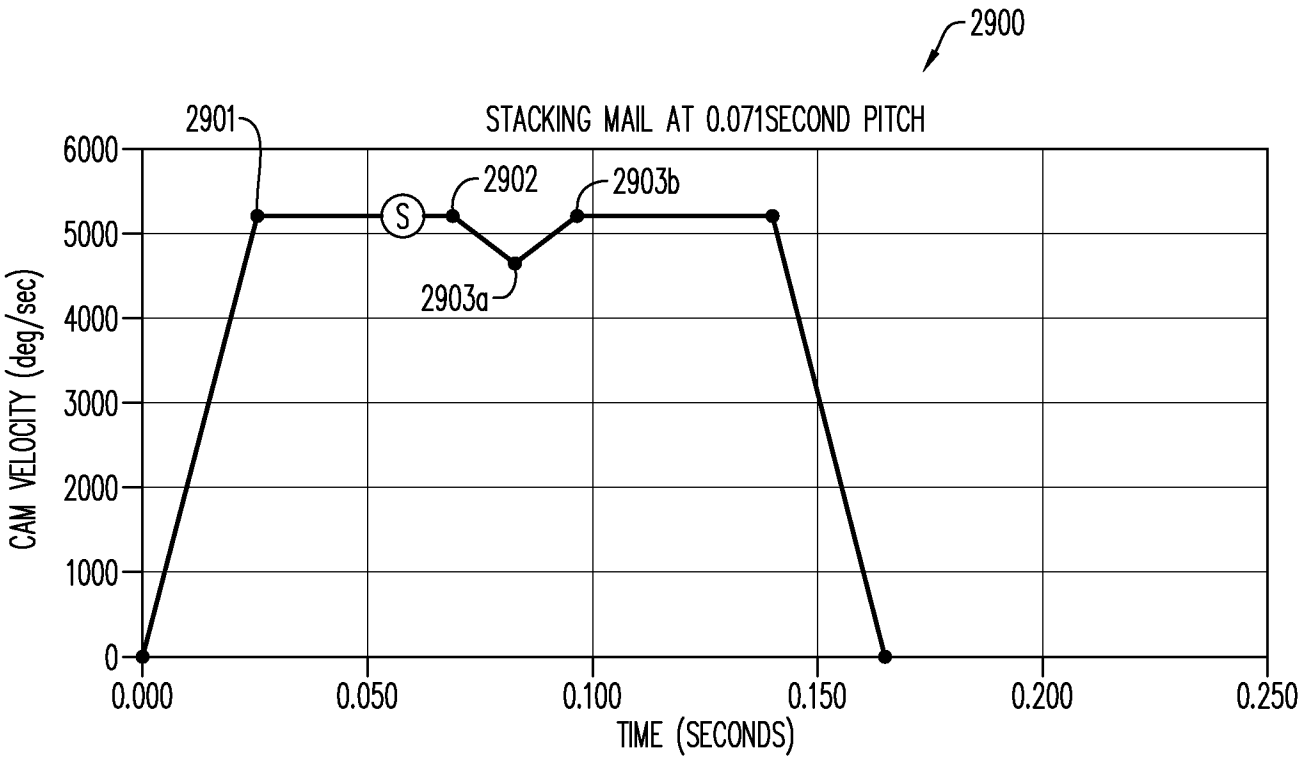

For even smaller mail pitches, the sensor is hit even earlier. Since the first mail-piece isn't done being stacked when the sensor is hit, the intercept profile won't begin until 295 degrees. For example, in the graph 2900 of FIG. 29 acceleration is complete, the velocity is 5,200 degrees/sec, and the cycle position is 65 degrees at 2901. The sensor is hit at "S" and the controller will wait until 295 degrees to begin intercept. At 2902, constant velocity is complete, velocity is 5,200 degrees/sec, the cycle position is 295 degrees, and the controller will begin intercept to 65 degrees. At 2903*a*, the first portion of intercept complete. At 2903*b*, the second portion of intercept complete, the velocity is 5,200 degrees/sec, and the cycle position is 65 degrees.

Figure 30:
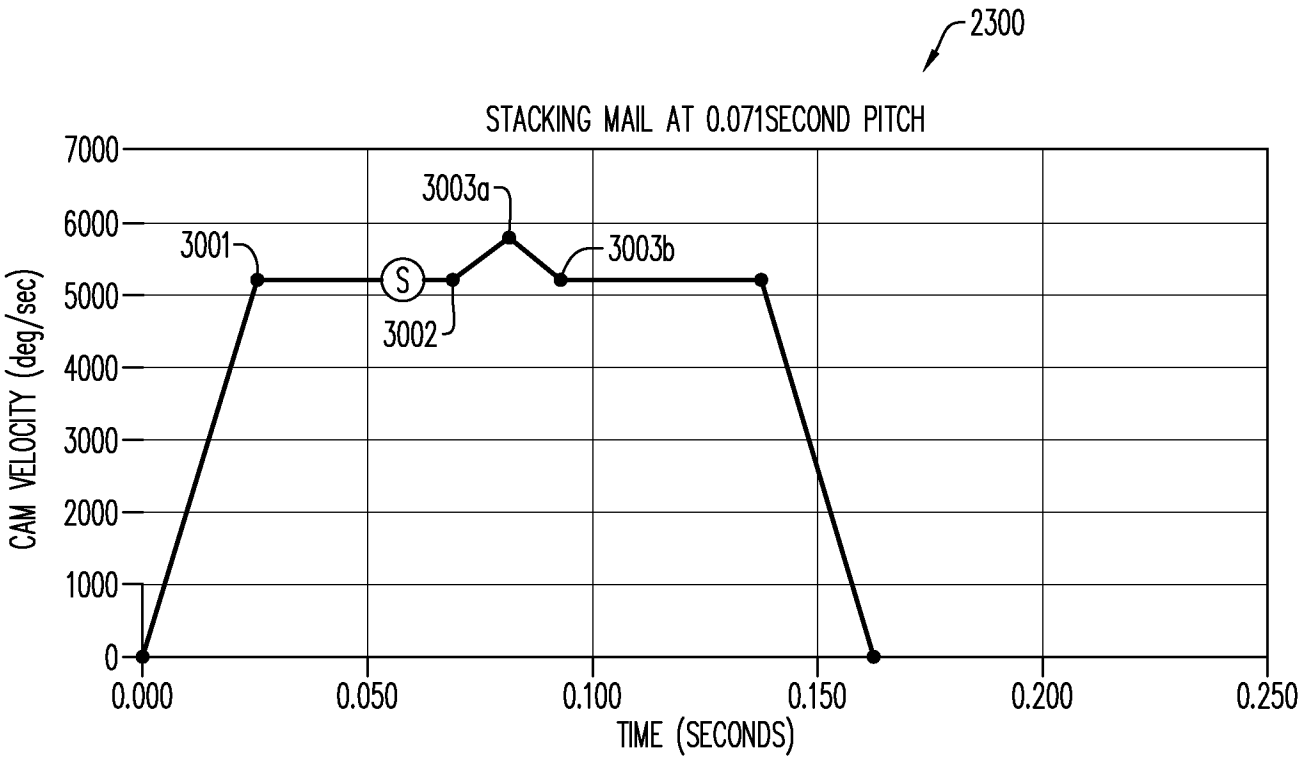

This profile occurs at even smaller pitches than previously occurred. FIG. 30 is a graph that illustrates intercept profile results in velocities greater than 5,200 degrees/sec. At 3001, acceleration is complete, the velocity is 5,200 degrees/sec, and the cycle position is 65 degrees. The sensor is hit at "S" and the controller will wait until 295 degrees to begin intercept. At 3002, the constant velocity is complete, the velocity is 5,200 degrees/sec, the cycle position is 295 degrees, and the controller will begin intercept to 65 degrees. At 3003*a*, the first portion of the intercept is complete. At 3003*b*, the second portion of intercept is complete, the velocity is, 5200 degrees/sec, and the cycle position is 65 degrees.

In summary, the divert/stacking assembly may employ a low cost, controllable, and highly accurate positioning device to drive multiple cams for aligning mail-pieces in a sortation bin. Embodiments may be able to stack mail from post cards up to thick flats effectively. Multiple tail cams or kicks may prevent lead edge to trail edge crashes. Since the kicks are close to each other, they may cover a substantial spectrum of mail sizes. According to some embodiments, a stacker may ingest a mix of mail types at any throughput of up to approximately 50,000 pieces per hour. Moreover, the most downstream cam may index out the mail stack by creating a zone for the mail-piece to enter then closing this zone the entire stack will generally be pushed out (e.g., into the sortation bin by a thickness of that mail-piece). That is, the system automatically indexes out the mail stack using the main cam so an external motor for conveying is not needed. Moreover, embodiments do not use any friction elements (which could either wear out or generate heat).

Although specific hardware and data configurations have been described herein, note that any number of other configurations may be provided in accordance with embodiments of the present invention (e.g., in other types of mixed mail cam stackers). Moreover, although some embodiments are focused on particular mail-piece sizes, any of the embodiments described herein could be applied to other types of mail-pieces (e.g., by altering the size, number, and/or location of the cams).

The present invention has been described in terms of several embodiments solely for the purpose of illustration. Persons skilled in the art will recognize from this description that the invention is not limited to the embodiments described but may be practiced with modifications and alterations limited only by the spirit and scope of the appended claims.

The invention claimed is:

1. A stacking assembly to accept mail-pieces traveling from a re-direct mechanism in a first direction comprising:

a plurality of sortation bins, including a first sortation bin associated with a first plurality of neighboring cam shafts, each of the first plurality of neighboring cam shafts having at least one cam arranged along the first direction, such that rotation of the first plurality of neighboring cam shafts by a driving mechanism results in synchronized rotation of the cams to:

(i) guide a leading edge portion of an incoming mail-piece toward a registration wall of the first sortation bin, and (ii) urge a previously stacked mail-piece away from the cams, and into the first sortation bin, in a second direction perpendicular to the first direction, wherein each of the first plurality of neighboring cam shafts has a plurality of cams.

2. The stacking assembly of claim 1, wherein each cam in a cam shaft is proximate to at least one associated cam in a neighboring cam shaft to form a cam row.

3. The stacking assembly of claim 2, wherein the stacking assembly includes a total of four cam shafts and a total of three cam rows.

4. The stacking assembly of claim 3, wherein each cam in a cam shaft being offset along the cam shaft with respect to cams in neighboring cam shafts, within the same cam row, allowing them to overlap in the first direction.

5. The stacking assembly of claim 1, wherein the cam shafts are linked together so as to rotate in a sequential manner such that:

(i) a path into the registration wall opens up just in time for the leading edge of a mail-piece to pass through, (ii) the cams continue to rotate to help a tail end of the mail-piece into place, and (iii) at least one cam then generally provides force in the second direction on a stack of previously accepted mail-pieces in the first sortation bin.

6. The stacking assembly of claim 1, wherein the stacking assembly is part of a mail-piece sorting device.

7. The stacking assembly of claim 1, further comprising:

a beam detector to generate a trigger signal when a beam is blocked by the leading edge of the incoming mail-piece; and a controller, operatively coupled to the cam shafts, to initiate rotation of the cam shafts by the driving mechanism upon receipt of the trigger signal.

8. The stacking assembly of claim 7, wherein the controller alters rotation of the cam shafts in accordance with a calculated intercept motion profile.

9. The stacking assembly of claim 1, further comprising:

a dampening element to dampen motion of a sortation bin paddle in the second direction.

10. The stacking assembly of claim 1, further comprising:

a spring arm top finger to prevent the leading edge the incoming mail-piece from colliding with a trailing edge of a previously accepted mail-piece.

11. A divert assembly operative to sort mail-pieces comprising:

a re-direct mechanism;

a controller operatively coupled to the re-direct mechanism; and a stacking assembly, operatively coupled to the controller, to accept mail-pieces traveling from the re-direct mechanism in a first direction including:

a plurality of sortation bins, including a first sortation bin associated with a first plurality of neighboring cam shafts, each of the first plurality of neighboring cam shafts having at least one cam arranged along the first direction, such that rotation of the first plurality of neighboring cam shafts by a driving mechanism results in synchronized rotation of the cams to:

(i) guide a leading edge portion of an incoming mail-piece toward a registration wall of the first sortation bin, and (ii) urge a previously stacked mail-piece away from the cams, and into the first sortation bin, in a second direction perpendicular to the first direction, wherein each of the first plurality of neighboring cam shafts has a plurality of cams.

12. The divert assembly of claim 11, wherein each cam in a cam shaft is proximate to at least one associated cam in a neighboring cam shaft to form a cam row.

13. The divert assembly of claim 12, wherein the stacking assembly includes a total of four cam shafts and a total of three cam rows.

14. The divert assembly of claim 13, wherein each cam in a cam shaft being offset along the cam shaft with respect to cams in neighboring cam shafts, within the same cam row, allowing them to overlap in the first direction.

15. The divert assembly of claim 11, wherein the cam shafts are linked together so as to rotate in a sequential manner such that:

(i) a path into the registration all opens up just in time for the leading edge of a mail-piece to pass through, (ii) the cams continue to rotate to help a tail end of the mail-piece into place, and (iii) at least one cam then generally provides force in the second direction on a stack of previously accepted mail-pieces in the first sortation bin.

16. The divert assembly of claim 11, wherein the stacking assembly is part of a mail-piece sorting device.

17. The divert assembly of claim 11, further comprising:

a beam detector to generate a trigger signal when a beam is blocked by the leading edge of the incoming mail-piece, wherein the controller is operatively coupled to the cam shafts and initiates rotation of the cam shafts by the driving upon receipt of the trigger signal.

18. The divert assembly of claim 17, wherein the controller alters rotation of the cam shafts in accordance with a calculated intercept motion profile.

* * * * *